United States Patent [19]

Shirai

[11] 4,418,499

[45] Dec. 6, 1983

[54] CUTTER GRINDING MACHINE

[75] Inventor: Shigeji Shirai, Shizuoka, Japan

[73] Assignee: Shinko Machinery Works Inc., Shizuoka, Japan

[21] Appl. No.: 201,466

[22] Filed: Oct. 28, 1980

[30] Foreign Application Priority Data

| | | | |
|---|---|---|---|
| Nov. 1, 1979 | [JP] | Japan | 54-141714 |
| Dec. 29, 1979 | [JP] | Japan | 54-172612 |
| Feb. 5, 1980 | [JP] | Japan | 55-12003 |
| Mar. 11, 1980 | [JP] | Japan | 55-31741[U] |

[51] Int. Cl.[3] ..... B24B 3/36

[52] U.S. Cl. ..... 51/3; 51/92 BS; 51/165.8; 51/165.92

[58] Field of Search ..... 51/3, 92, 165.77, 165.8, 51/165.92

[56] References Cited

U.S. PATENT DOCUMENTS

| | | | |
|---|---|---|---|
| 2,786,310 | 3/1957 | Jansson | 51/165.97 |
| 3,090,171 | 5/1963 | Stimson | 51/165.92 |
| 3,494,079 | 2/1970 | Klein | 51/165.8 |
| 3,827,190 | 8/1974 | Moriguchi | 51/165.92 |
| 3,885,352 | 5/1975 | Iuranitch | 51/3 |
| 3,978,624 | 9/1976 | Merkel | 51/165.92 |
| 4,023,084 | 5/1977 | Owa | 51/165.77 |
| 4,216,628 | 8/1980 | Wada | 51/165.77 |

*Primary Examiner*—Harold D. Whitehead

[57] ABSTRACT

A grinding machine for cutters used in wood working machines such as superfinishing wood planing machines. The cutter grinding machine comprises a cutter rest, to which a cutter to be ground is attached, and grinding wheels being adapted so that either of them moves toward or away from the cutter; a proximate position-detecting means being provided for detecting a fixed proximity between the cutter and one of the grinding wheels; and a sequential-control means being provided so that the approximation between the cutter rest and the grinding wheel is temporarily stopped when the proximate position-detecting means has operated and then either the cutter rest or the grinding wheel is reciprocated in the direction for enabling the grinding wheel to grind the cutter. Even when the grinding wheels are worn down, each of them can be automatically brought to a fixed position proximate to the cutter at the beginning of grinding operation to ensure proper and efficient grinding operation at all times.

5 Claims, 32 Drawing Figures

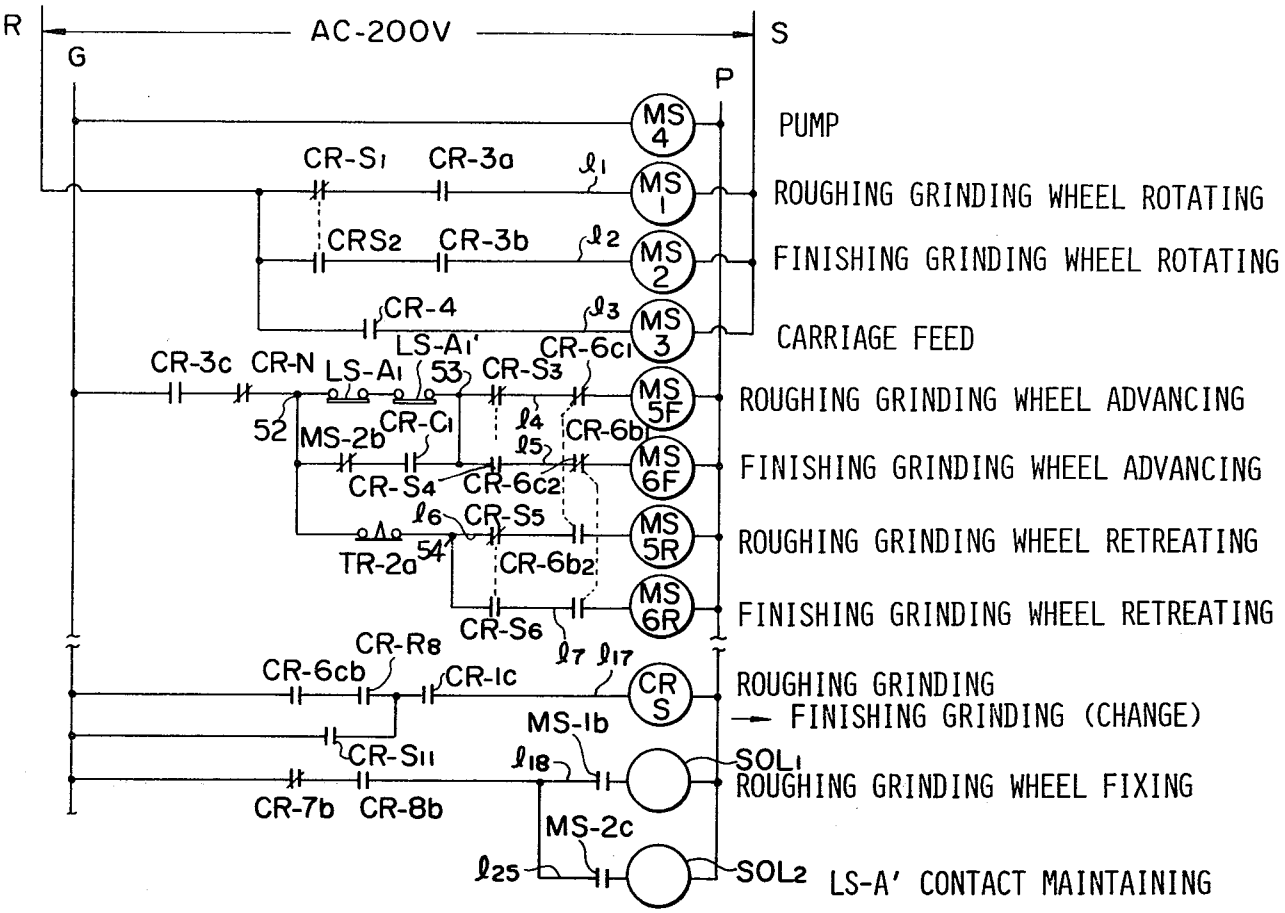
FIG. 26
AC-200V
R
G
P
S
PUMP
ROUGHING GRINDING WHEEL ROTATING
FINISHING GRINDING WHEEL ROTATING
CARRIAGE FEED
ROUGHING GRINDING WHEEL ADVANCING
FINISHING GRINDING WHEEL ADVANCING
ROUGHING GRINDING WHEEL RETREATING
FINISHING GRINDING WHEEL RETREATING
ROUGHING GRINDING
FINISHING GRINDING (CHANGE)
ROUGHING GRINDING WHEEL FIXING
LS-A' CONTACT MAINTAINING
MS 4
MS 1
MS 2
MS 3
MS 5F
MS 6F
MS 5R
MS 6R
CR S
SOL1
SOL2
CR-S1
CR-3a
CRS2
CR-3b
CR-4
CR-3c
CR-N
LS-A1
LS-A1'
CR-C1
MS-2b
CR-6c1
CR-S3
CR-6b
CR-6c2
CR-S4
CR-S5
CR-6b2
TR-2a
CR-S6
CR-6cb
CR-R8
CR-1c
CR-S11
CR-7b
CR-8b
MS-1b
MS-2c
52
53
54
ℓ1
ℓ2
ℓ3
ℓ4
ℓ5
ℓ6
ℓ7
ℓ17
ℓ18
ℓ25

CUTTER GRINDING MACHINE

BACKGROUND OF THE INVENTION (1) Field of the Invention

The present invention relates to a grinding machine for cutters used in wood working machines such as superfinishing wood planing machines.

(2) Description of the Prior Art

Cutters used in wood working machines such as superfinishing wood planing machines have to be sharpened precisely.

Japanese Patent Publication No. Sho 47-42590 discloses a cutter grinding machine which comprises a carriage being disposed laterally movable on a bed; a cutter holder being provided on said carriage, to which holder a cutter is attached from above so that its ground surface is horizontal; a vertical strut being provided at the rear of said carriage; a turning member being fitted to said vertical strut; a grinding wheel and a lapping wheel being respectively attached vertically movable to said turning member; either of said grinding wheel and lapping wheel being selectively brought into contact with the cutter by the turn of said turning member so as to perform the grinding and lapping of the cutter alternately.

The grinding wheel, etc. are worn down by grinding operation. Furthermore, the grinding wheel and the lapping wheel differ from one another in the quantity of wear because they are different in hardness and frequency of use.

In the grinding machine of the prior art, whenever such difference in the amount of wear has appeared, it is necessary to adjust the positions of the grinding wheel and lapping wheel manually by means of hand wheels while watching them. However, it is very troublesome to do so, and furthermore, it is difficult to keep the extent of the grinding or lapping constant.

There has also been a grinding machine in which the vertical movement of each grinding wheel is performed semi-automatically. That is, the grinding wheel is moved down to a position proximate to the cutter by a vertically driving device, but the operator has to confirm the proximate position visually and stop the vertically driving device, then he has to lower the grinding wheel manually until it comes into contact with the cutter. However, this semi-automatic grinding machine has the disadvantage that the position of each grinding wheel has to be readjusted often and manually, because it is worn down by grinding operation. Therefore, the efficiency of operation is reduced.

BRIEF SUMMARY OF THE INVENTION

It is therefore an object of this invention to provide a cutter grinding machine which has obviated the above-mentioned disadvantages of the prior art. This object has been attained by a cutter grinding machine which comprises a cutter rest, to which a cutter to be ground is attached, and grinding wheels being adapted so that either of them moves toward or away from the cutter, a proximate position-detecting means being provided for detecting a fixed proximity between the cutter and one of the grinding wheels; and a sequential-control means being provided so that the approximation between the cutter rest and said grinding wheel is temporarily stopped when the proximate position-detecting means has operated and then either the cutter rest or the grinding wheel is reciprocated in the direction for enabling the grinding wheel to grind the cutter. Even when the grinding wheels are worn down, each of them can be brought automatically to a fixed position proximate to the cutter at the beginning of the grinding operation to ensure proper grinding operation at all times.

The 1st Embodiment of the present invention includes a counting system for counting the number of times said cutter rest or said grinding wheel is reciprocated so that the grinding operation is performed until a preset number of times of said reciprocation is concluded. Therefore, a desired degree of cutting, finishing, etc. is always obtained irrespective of the stroke of said reciprocation. The counting system combines with said proximate position-detecting means to ensure more accurate and efficient grinding operation.

In the 2nd Embodiment of the present invention, a roughing grinding wheel system and a finishing grinding wheel system respectively are provided with a 1st proximate position-detecting means and a 2nd proximate position-detecting means, and only the finishing grinding wheel system is provided with a pressing means for pressing a finishing grinding wheel against the cutter. When the 2nd proximate position-detecting means has operated, a finishing grinding wheel feed motor is stopped and the pressing means is actuated so as to press the finishing grinding wheel against the ground surface of the cutter, then either the cutter rest or the finishing grinding wheel is reciprocated in the direction to enable the finishing grinding wheel to grind the cutter. Therefore, the 2nd Embodiment is very suitable for a finishing grinding operation in which the quantity of grinding is very small.

In the 3rd Embodiment of the present invention, the grinding operation is regulated with respect to time. Therefore, a cutter grinding machine of this embodiment is simpler in construction.

Other and further objects, features and advantages of the invention will appear more fully from the following description.

DESCRIPTION OF THE DRAWINGS

FIG. 13 is a partly sectional side view showing an example in which each grinding wheel is fixed on a mount adapted to turn downward.

FIG. 14 is a partly sectional side view showing an example in which each threaded feed shaft is provided with a splined portion.

FIG. 15 is a schematic plan view showing an example in which a cutter rest is provided with a contact piece.

FIG. 16 is a schematic side view showing an example in which an air blowing nozzle is used.

FIG. 17 is a side view with an electric circuit diagram, showing an example in which each grinding wheel is covered with an electrically conductive film.

FIG. 18 (A) and FIG. 18 (B) are sectional views of grinding wheels used therein.

FIG. 19 is a side view with an electric circuit diagram, showing an example in which sparks are utilized for detection.

FIG. 24 (B) is an enlarged sectional side view of a portion thereof.

FIG. 26 is an electric circuit diagram, partly omitted, showing an example of a sequential-control circuit used in the 2nd Embodiment of the present invention.

DETAILED DESCRIPTION

The present invention will now be described in detail with reference to the accompanying drawings.

1st EMBODIMENT

Figure 1:
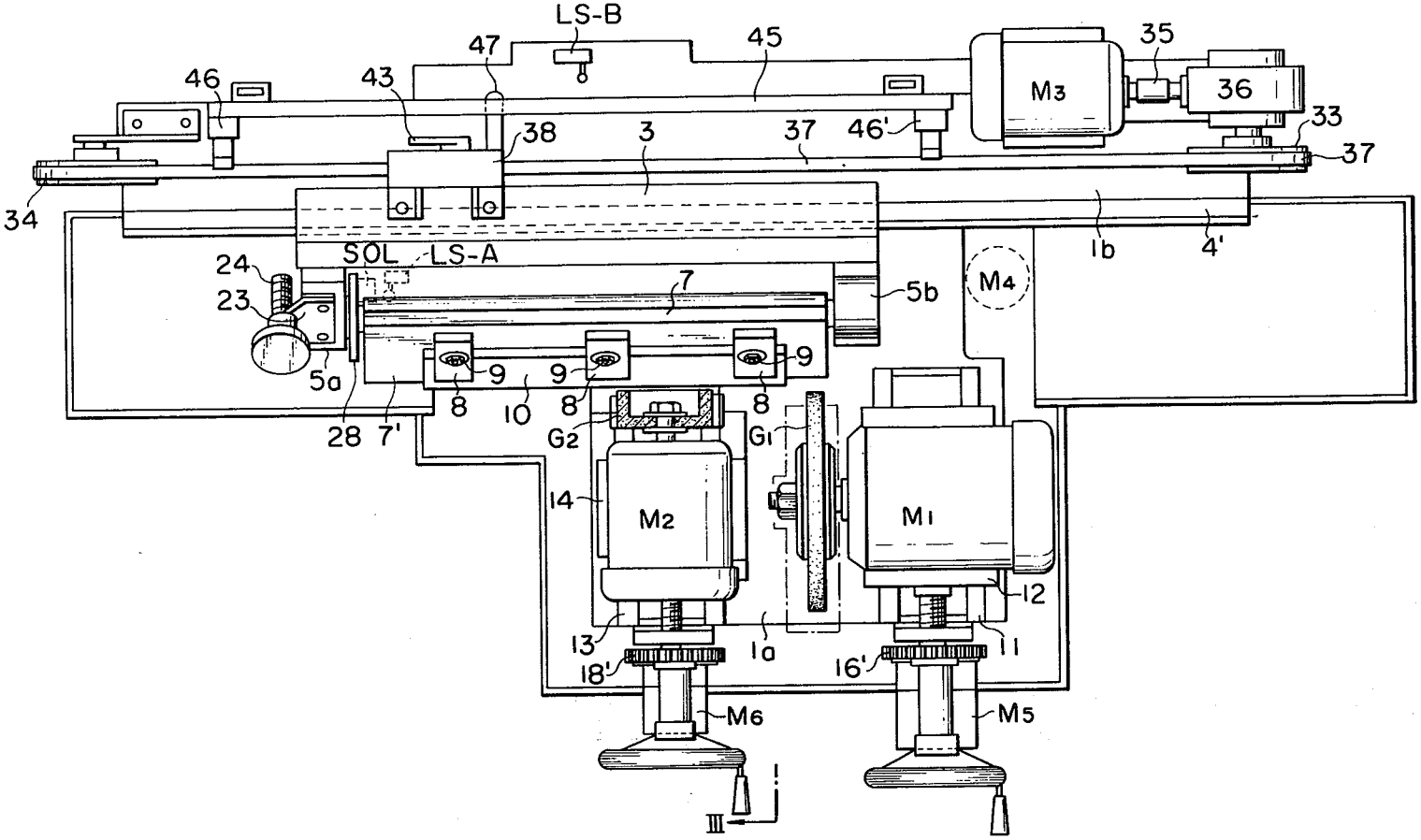
FIG. 1 is a plan view of a cutter grinding machine of the 1st Embodiment of the present invention.
Figure 2:
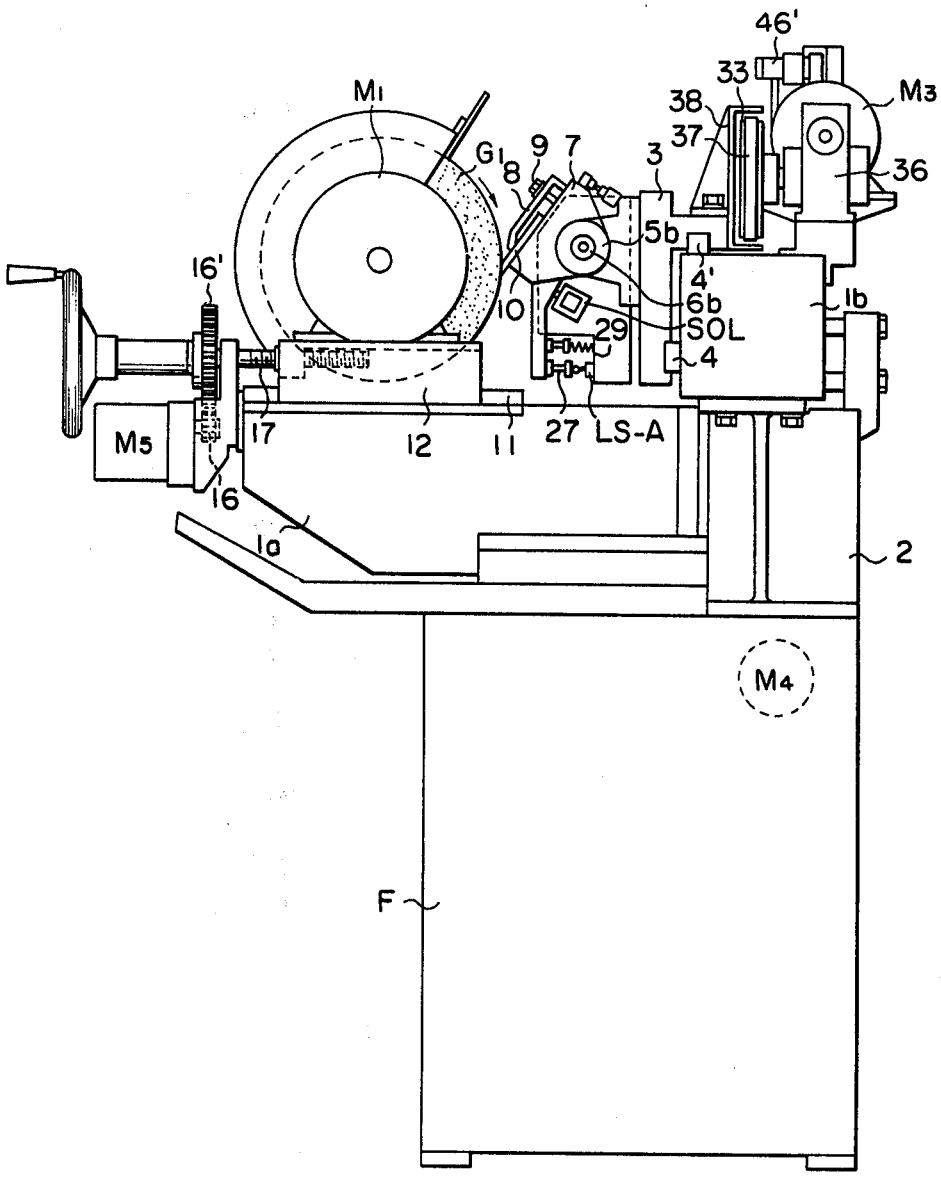
FIG. 2 is a right side view thereof.
Figure 3:
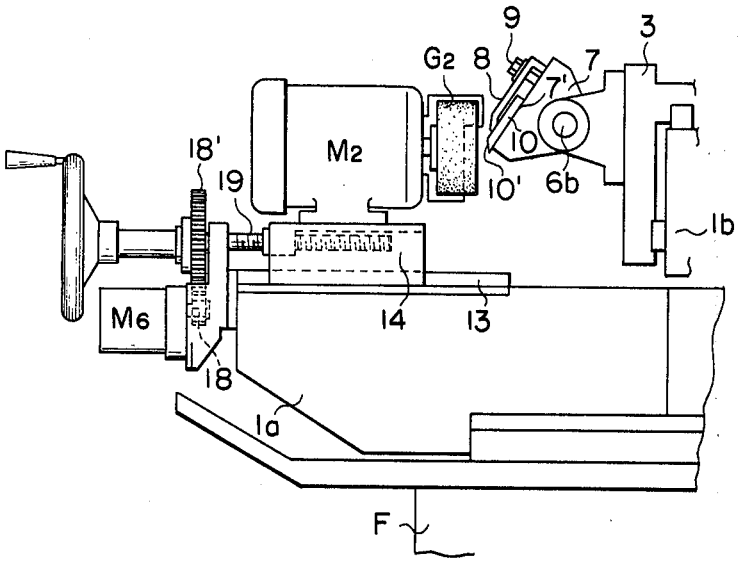
FIG. 3 is a side view of a finishing grinding wheel portion, taken in the direction of the arrow III of FIG. 1.

FIGS. 1 to 3 show the mechanical composition of a cutter grinding machine which is the 1st Embodiment of the present invention. In these figures, letter F represents a frame. A horizontal bed 1*a* is disposed in the front on top of the frame F (in the lower position in FIG. 1), and a vertical bed 1*b* is disposed, through a supporting member 2, in the rear on top of the frame F.

In front of the vertical bed 1*b*, a carriage 3 shaped like a flat board is disposed on guide rails 4 and 4' so that it reciprocates toward the right side and left side in FIG. 1.

Figure 4:
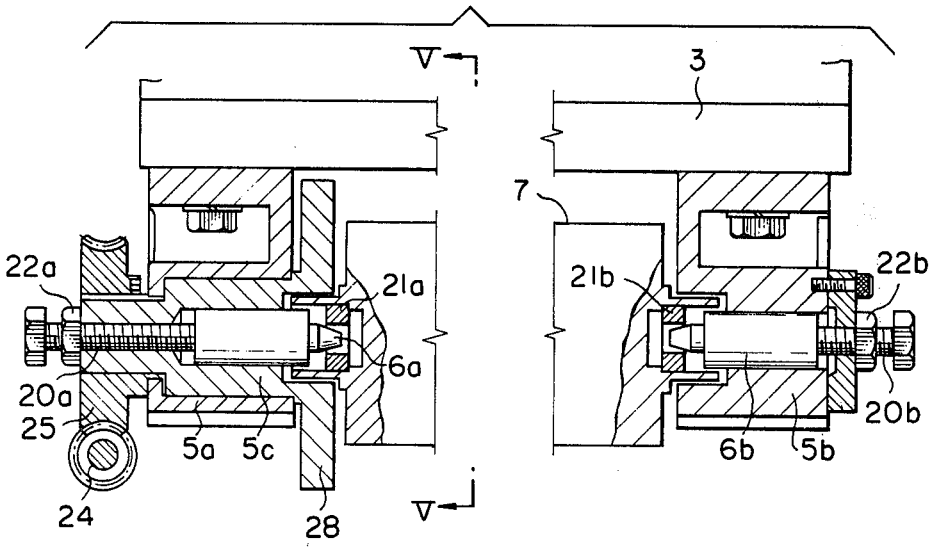
FIG. 4 is an enlarged plan view, partly in section, of the cutter rest portion in FIG. 1.

The flat front surface of the carriage 3 is substantially vertical. A pair of bearings 5*a* and 5*b* are attached to the right and left sides of the flat surface. A cutter rest 7 is supported between rotatable shafts 6*a* and 6*b* which are supported in the bearings 5*a* and 5*b* as shown in FIG. 4.

The cutter rest 7 is provided on its cutter fixing surface 7' with cutter holders 8, 8—and clamping bolts 9, 9—. The cutter rest 7 is adapted to keep its cutter fixing surface 7' inclined so that the ground surface 10' of a cutter 10 fixed thereon by means of the clamping bolts 9,9—is substantially vertical. The cutter rest 7 is rotatable within a limited range as described below.

Grinding wheels are disposed on said horizontal bed 1*a* so as to be movable in the direction at right angles to the direction of the reciprocation of the cutter rest 7.

In an illustrated example, the grinding wheels consist of a roughing grinding wheel G1 and a cup-shaped finishing grinding wheel G2. The roughing grinding wheel G1 is fixed to the output shaft of a roughing grinding wheel rotating motor M1 which is transversely mounted on a slide rest 12, said slide rest 12 being slidably mounted on feed guides 11 provided on the horizontal bed 1*a*.

The finishing grinding wheel G2 is fixed to the output shaft of a finishing grinding wheel rotating motor M2 which is mounted on another slide rest 14 in the same direction as the movement thereof, said slide rest 14 being slidably mounted on other feed guides 13 disposed in parallel with said feed guides 11.

Symbol M5 represents a roughing grinding wheel feed motor, and symbol M6 represents a finishing grinding wheel feed motor. The roughing grinding wheel feed motor M5 is associated, through gears 16, 16' and a threaded feed shaft 17, with the slide rest 12 for the roughing grinding wheel G1.

The finishing grinding wheel feed motor M6 is associated, through gears 18, 18' and a threaded feed shaft 19, with the slide rest 14 for the finishing grinding wheel G2.

Thus, the roughing grinding wheel G1 and the finishing grinding wheel G2 each are advanced by their respective feed motors toward the cutter 10 fixed on the cutter rest 7 with its ground surface 10' substantially vertical.

Examples of a cutter angle-adjusting mechanism and a proximate position-detecting means for advancing the grinding wheels to a fixed position proximate to the cutter 10 will be described with reference to FIGS. 4 and 5.

Referring first to the cutter angle-adjusting mechanism, an inner bearing 5*c* is rotatably fitted in the left beariing 5*a* as shown in FIG. 4.

A left push screw 20*a* is in threaded engagement with the inner bearing 5*c* so as to push the tapered end of the rotatable shaft 6*a* into a shaft bearing portion 21*a* of the cutter rest 7. With respect to the right bearing 5*b*, a right push screw 20*b*, the rotatable shaft 6*b* with a tapered end, and a shaft bearing portion 21*b* of the cutter rest 7 are disposed correspondingly to the left side.

The cutter rest 7 is supported between the tapered ends of the rotatable shafts 6*a* and 6*b* by tightening the push screws 20*a* and 20*b*, and is locked in by means of lock nuts 22*a* and 22*b*. The cutter rest 7 is rotatable with respect to the rotatable shafts 6*a* and 6*b* within a limited range as described below.

The following are disposed beside said inner bearing 5*c*; As shown also in FIG. 1, an inclined bearing 23 is attached to the left bearing 5*a*, and a threaded handle shaft 24 is supported in the inclined bearing 23. A worm wheel 25, adapted to mesh with the threads of the handle shaft 24, is fixed to one side of the inner bearing 5*c* so that the handle shaft 24, when turned, turns the cutter rest 7 with the inner bearing 5*c* so as to adjust the angle of the cutter rest 7 and therefore the angle of the cutter 10 fixed thereon.

Although the cutter rest 7 is adapted to be turned by the rotatable shafts 6*a* and 6*b*, the amount of turn of the cutter rest 7 with respect to the inner bearing 5*c* is limited as described below. Therefore, the angle of the cutter rest 7 is adjusted by turning the inner bearing 5*c* itself.

Reference will now be made to an example of the proximate position-detecting means.

Figure 5:
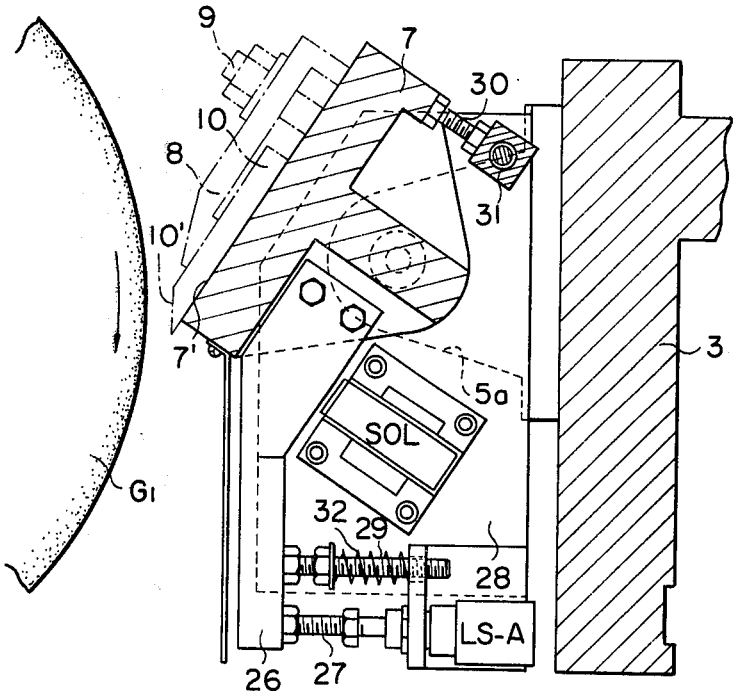
FIG. 5 is a sectional view taken on Line V—V of FIG. 4.

As shown in FIG. 5, a stay 26 is fixed to the back of the cutter rest 7 so as to extend downward therefrom, and a switch-actuating member 27 is attached to the back of the stay 26 so as to extend rearward therefrom. A support plate 28 is fixed to the inner bearing 5*c*, and a limit switch LS-A corresponding to the switch-actuating member 27 is fixed to the support plate 28.

A threaded shaft 29 is attached to the stay 26 near the switch-actuating member 27. The threaded shaft 29 is provided with a push spring 32, slipped over the shaft 29 and disposed between the stay 26 and the support plate 28 so as to give the cutter rest 7 a tendency to turn clockwise around the rotatable shafts 6*a* and 6*b*. Said tendency to turn is controlled by a stopper bolt 30 attached to an upper rear portion of the cutter rest 7 and a stopper piece 31, corresponding thereto, fixed to the support plate 28.

A solenoid, symbol SOL, for fixing the cutter rest 7 is attached to the support plate 28 so as to be in the rear of the stay 26.

When either the roughing grinding wheel G1 or the finishing grinding wheel G2 is advanced and brought into contact with the ground surface 10' of the cutter 10 by the feed motor M5 or M6, the cutter rest 7 is turned counterclockwise (in FIG. 5) so as to move the ground surface 10' back slightly and to actuate the limit switch LS-A which, in turn, opens the power circuit of the feed motor M5 or M6 to stop the advance of the grinding wheel G1 or G2. At the same time, the limit switch LS-A actuates the solenoid SOL, which attracts and fixes the cutter rest 7.

Thus, the ground surface 10' of the cutter 10 is fixed in a withdrawn position, and the feed motor M5 or M6 is stopped. Because the grinding wheel G1 or G2 has a slight tendency to continue to advance by inertia, the grinding wheel G1 or G2 stops in a position very close to the ground surface 10' so that it is ready for grinding operation.

A carriage reciprocating mechanism will now be described with reference to FIG. 6.

The carriage reciprocating mechanism is disposed at the rear of the carriage 3. A carriage feed motor M3, adapted to rotate in one direction only, is disposed at the rear of the vertical bed 1*b*. A driving pulley 33 and a driven pulley 34 are disposed vertically on both ends of the vertical bed 1*b*. The driving pulley 33 is connected, through a coupling 35 and a reduction gear 36, with the carriage feed motor M3.

Numeral 37 represents a V-belt connecting the pulleys 33 and 34 with one another.

A transmission member 38 is attached to the back of the carriage 3 so as to be positioned between the carriage 3 and the V-belt 37. An upper push lever 39 and a lower push lever 40 are pivotally attached to the transmission member 38 and their pivots are provided with arc-shaped gears 41 and 42 which are in meshing contact with one another.

Each of the push levers 39 and 40 is adapted to grasp the V-belt 37 in between when it is pushed against the belt. When the upper push lever 39 is pushed against the upper portion of the V-belt 37 as shown in FIG. 6., the transmission member 38 and therefore the carriage 3 travel in the direction of travel of the upper portion of the V-belt 37, that is, toward the left in FIG. 6. When the lower push lever 40 is pushed against the lower portion of the V-belt 37, the transmission member 38 and therefore the carriage 3 travel toward the right in FIG. 6.

A changeover lever 43 extends upward from the upper push lever 39, and is provided on both sides thereof with buffer leaf springs 44.

A stay 45 is disposed in parallel with the V-belt 37, and is provided on the ends thereof with projecting stroke control members 46 and 46' corresponding to the changeover lever 43.

Figure 6:
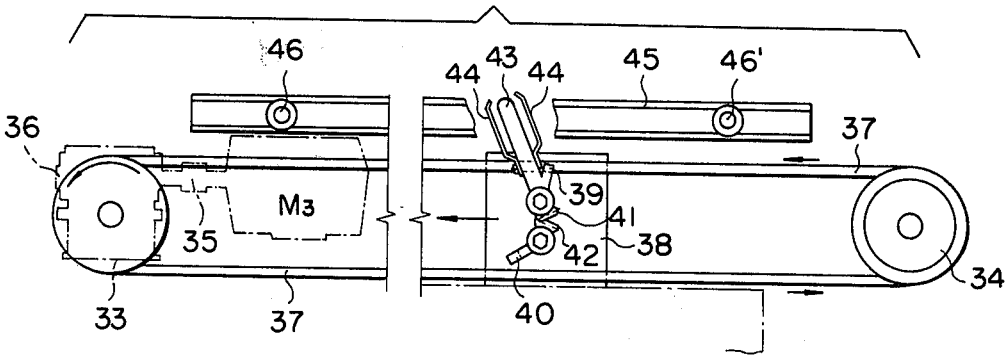
FIG. 6 is a schematic front view of a carriage reciprocating mechanism in FIG. 1.

In FIG. 6, the transmission member 38 travels toward the left, and the changeover lever 43 contacts the stroke control member 46 and turns clockwise. Then, the upper push lever 39 separates from the upper portion of the V-belt 37, and the lower push lever 40 grasps the lower portion of the V-belt 37. Therefore, the transmission member 38 begins to travel toward the right.

Thus, the carriage 3 reciprocates in spite of the fact that the V-belt 37 is turned in one direction only by the carriage feed motor M3.

In FIG. 1, numeral 47 represents a switch-actuating lever projecting from the back of the transmission member 38, and symbol LS-B represents a counting limit switch corresponding thereto fixed on the vertical bed 1*b*. The switch-actuating lever 47 and the counting limit swich LS-B are used for starting the advance of the roughing grinding wheel G1 or the finishing grinding wheel G2, or for driving the stepping action of a stepping relay, as described later in detail.

Symbol M4 in FIG. 1 represents a motor for the cooling water pump used for supplying water to the ground surface 10' of the cutter 10.

In an example shown in FIGS. 1, 3, etc., infeed (forward and backward movement) is performed on the part of the grinding wheels, and lateral reciprocation is performed on the part of the cutter, the motors M1 and M2 for rotating the roughing grinding wheel G1 and the finishing grinding wheel G2 being disposed horizontally movable on the horizontal bed 1*a*. However, such mechanism and disposition may be changed, for instance, as follows: the infeed (forward and backward movement) can be performed on the part of the cutter and the lateral reciprocation performed on the part of the grinding wheels; or both of the movements can be performed on the part of either the grinding wheels or the cutter; and the motors for rotating the grinding wheels can be vertically movable.

Figure 7:
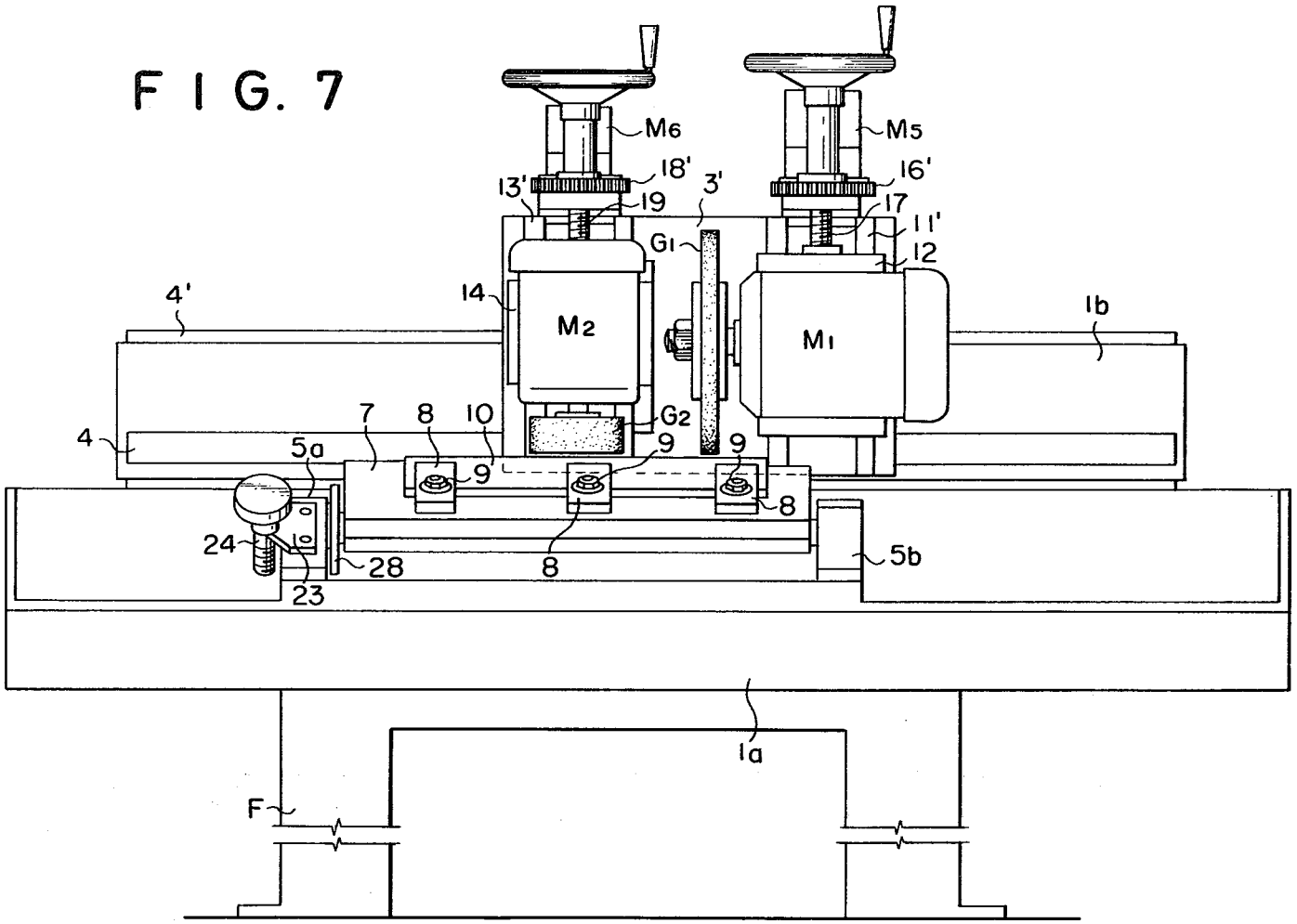
FIG. 7 is a front view of a variation of FIG. 1.
Figure 8:
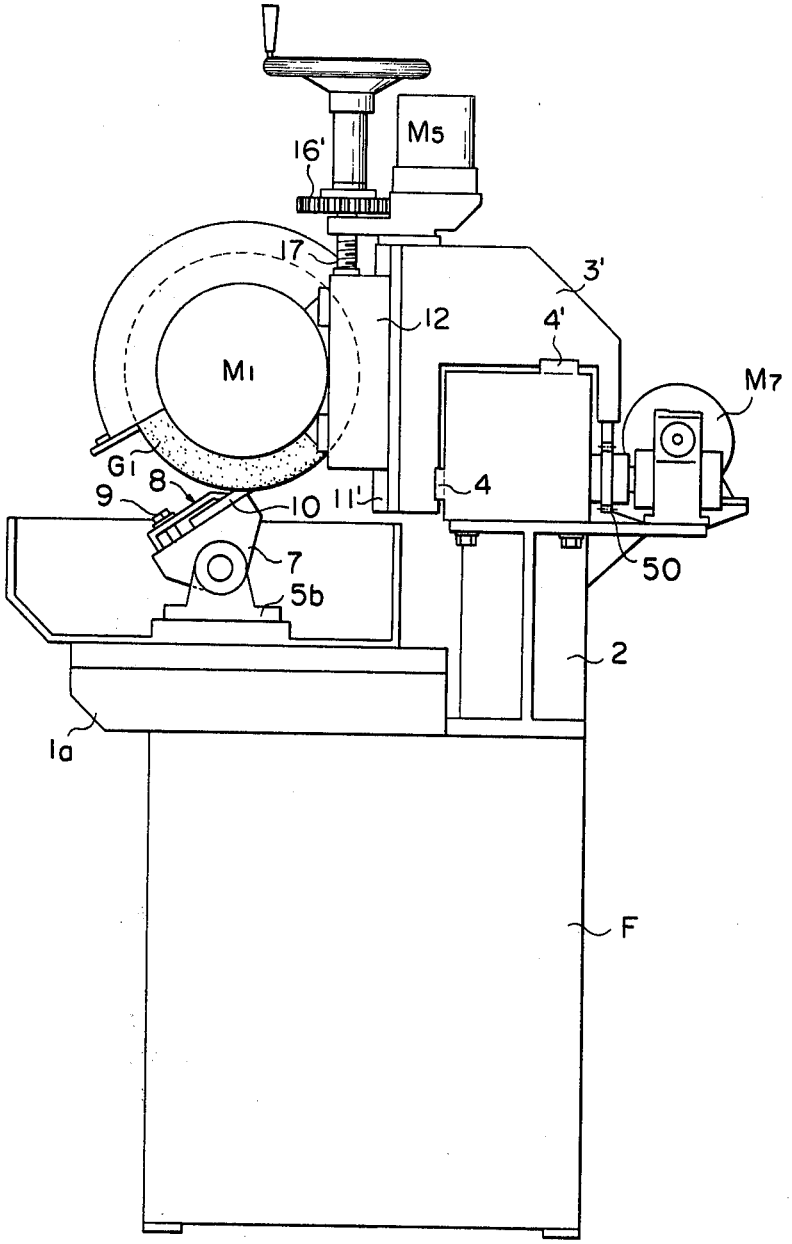
FIG. 8 is a right side view thereof.

FIGS. 7 and 8 show one of said variations, in which both infeed (forward and backward movement) and lateral reciprocation are performed on the part of the grinding wheels, neither of them being performed on the part of the cutter, and the motors for rotating the grinding wheels are vertically movable.

In the example shown in FIGS. 7 and 8, the cutter rest 7 is fixed, through the bearings 5*a* and 5*b*, on the horizontal bed 1*a*, and the cutter 10 is attached to the cutter rest 7 so that its ground surface 10' is kept substantially horizontal.

The grinding wheels G1 and G2 are disposed on a carriage 3' so that they reciprocate laterally and move vertically. Feed guides 11', 11' and 13', 13' are vertically disposed in front of the carriage 3'. The roughing grinding wheel rotating motor M1 is attached, through the slide rest 12, to the feed guides 11', 11' so as to be vertically movable. The finishing grinding wheel rotating motor M2 is attached, through the slide rest 14, to the feed guides 13', 13' so as to be vertically movable.

Each of the roughing grinding wheel G1 and the finishing grinding wheel G2 is moved down by their motors toward the cutter 10 attached to the cutter rest 7 with its ground surface 10' substantially horizontal.

In FIGS. 7 and 8, members or portions which are the same as, or equivalent to, those shown in FIGS. 1 to 5 are represented by the same numerals or symbols as the latter.

Figure 9:
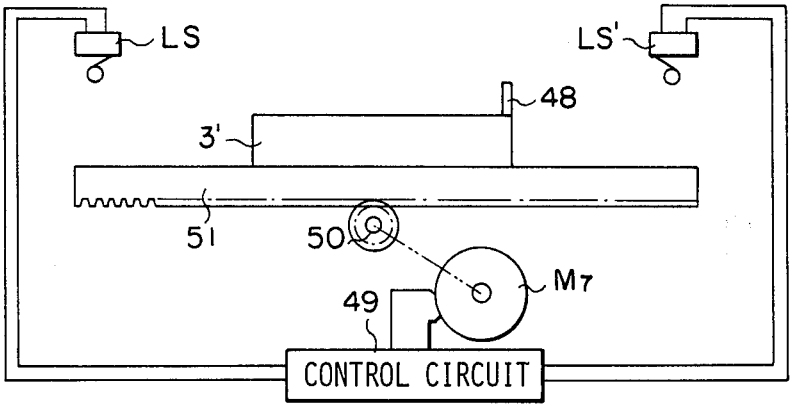
FIG. 9 is a schematic view showing an example of a carriage reciprocating mechanism in FIG. 7.

FIG. 9 shows an example of the reciprocating mechanism of the carriage 3' used in the cutter grinding machine in FIGS. 7 and 8. A limit switch-actuating member 48 is attached to the back of the carriage 3', and a pair of limit switches LS and LS', corresponding thereto, are disposed on the right and left side respectively (in FIG. 9) of the bed. The limit switches LS and LS' are for controlling the stroke of the carriage 3'.

The contact output of the limit switches LS and LS' is put into a control circuit 49, which rotates a reversible motor M7 in alternate directions. Thus, the reversible motor M7 reciprocates the carriage 3' through a pinion 50 and a rack 51.

The carriage reciprocating mechanism shown in FIG. 9 may be used, not only in the cutter grinding machine shown in FIGS. 7 and 8, but also in the cutter grinding machine shown in FIGS. 1 and 3 in place of the carriage reciprocating mechanism shown in FIG. 6. Also, the latter mechanism may be used in the cutter grinding machine shown in FIGS. 7 and 8 in place of the alternative mechanism.

The power circuit and control circuit for the sequential control of the cutter grinding machine shown in FIGS. 1 and 6 or FIGS. 7 and 9 will now be described with reference to FIGS. 10 and 11.

Figure 10:
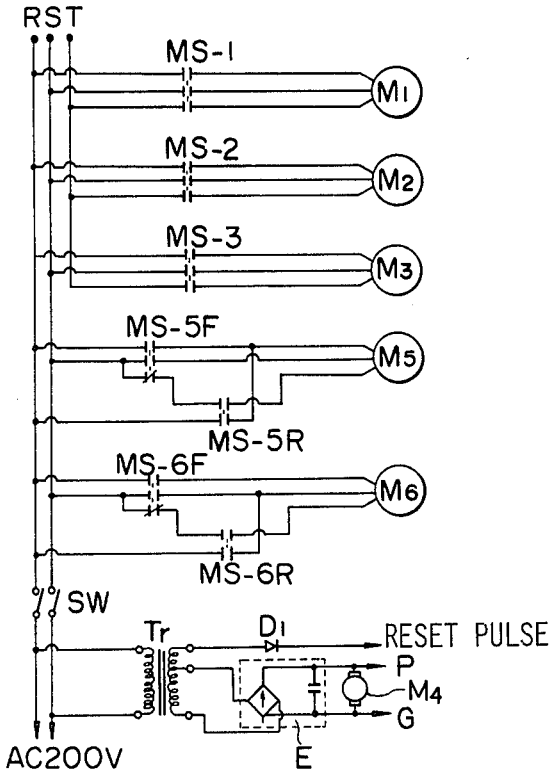
FIG. 10 is an electric circuit diagram showing an example of a power circuit used in the present invention.

FIG. 10 shows an example of the power circuit. In this figure, symbol M1 represents the roughing grinding wheel rotating motor, M2 is the finishing grinding wheel rotating motor, M3 is the carriage feed motor, M4 is the cooling water pump motor, M5 is the roughing grinding wheel feed motor, and M6 is the finishing grinding wheel feed motor. The roughing grinding wheel feed motor M5 is provided with a rotation-reversing circuit comprising switch contacts MS-5F and MS-5R. The finishing grinding wheel feed motor M6 is provided with a rotation-reversing circuit comprising switch contacts MS-6F and MS-6R.

Each of said motors M1 to M6 is the same as shown in FIG. 1, etc.

Symbol SW represents a power switch, Tr is a power transformer, and E is a rectified power source. Buses P and G for a sequential-control circuit described below are connected with the rectified power source E. A line with a diode D1 is a reset pulse output line for resetting a counter (for instance, an electronic counter or an electromagnetic counter) described below or a stepping relay shown in the figure.

Description will now be made of the sequential-control circuit shown in FIG. 11.

Some magnetic switches in the sequential-control circuit are for alternating-current use, and three control circuits l1, l2 and l3 as follows are provided between alternating-current buses R and S.

A roughing grinding wheel rotating circuit l1 is a series circuit comprising a break contact (hereinafter referred as as "contact b") CR-S1 of a grinding change relay CRS, a make contact (hereinafter referred to as "contact a") CR-3*a* of a 3rd relay CR3 and a 1st magnetic switch MS1.

A finishing grinding wheel rotating circuit l2 is a serier circuit comprising a contact "a" CR-S2 of the grinding change relay CRS, a contact "a" CR-3*b* of the 3rd relay CR3, and a 2nd magnetic switch MS2. A carriage feed circuit l3 is a series circuit comprising a contact "a" CR-4 of a 4th relay CR4 and a 3rd magnetic switch. The finishing grinding wheel rotating circuit l2 and the carriage feed circuit l3 are disposed in parallel with said roughing grinding wheel rotating circuit l1.

As shown in FIG. 10, a contact "a" MS-1 of the 1st magnetic switch MS1 is on the power line of the roughing grinding wheel rotating motor M1, a contact "a" MS-2 of the 2nd magnetic switch MS2 is on the power line of the finishing grinding wheel rotating motor M2, and a contact "a" MS-3 of the 3rd magnetic switch MS3 is on the power line of the carriage feed motor M3.

The following control circuits are disposed between the direct-current buses P and G:

A 4th magnetic switch MS4 for actuating the cooling-water-pump motor M4 is connected between the buses P and G.

A node 52 is provided on a line extending from the bus G and through a contact "a" CR-3*c* of the 3rd relay CR3 and a contact "b" CR-N of a cutting-finishing change relay CRN.

A parallel circuit, comprising a contact "b" LS-A1 of the limit switch LS-A, the postion of which is shown in FIG. 5, and a contact "a" CR-C1 of a grinding wheel advance starting relay CRC, is connected with the node 52. The other end of this parallel circuit is provided with a node 53.

It is to be noted that the limit switch LS-A is provided with a contact "a" LS-A2 in addition to said contact "b" LS-A1.

Between the node 53 and the bus P, a contact "b" CR-S3 of the grinding change relay CRS, a contact "b" CR-6*c*1 of a 3rd counter set relay CR6*c*, and a roughing grinding wheel advance driving magnetic switch MS5F are connected in series to form a roughing grinding wheel advancing circuit l4.

In parallel with the roughing grinding wheel advancing circuit l4, a finishing grinding wheel advancing circuit l5 is disposed, which comprises a contact "a" CR-S4 of the grinding change relay CRS, a contact "b" CR-6*b*1 of a 2nd counter set relay CR6*b*, and a finishing grinding wheel advance driving magnetic switch MS6F that are connected in series.

A node 54 is provided on a line extending from the node 52 and through a contact "b" TR-2*a* of a timer TR2. Between the node 54 and the bus P, a contact "b" CR-S5 of the grinding change relay CRS, a contact "a" CR-6*c*2 of the 3rd counter set relay CR6*c*, and a roughing grinding wheel retreating magnetic switch MS5R are connected in series to form a roughing grinding wheel retreating circuit l6.

In parallel with the roughing grinding wheel retreating circuit l6, a finishing grinding wheel retreating circuit l7 is disposed, which comprises a contact "a" CR-S6 of the grinding change relay CRS, a contact "a" CR-6*b*2 of the 2nd counter set relay CR6*b*, and a finishing grinding wheel retreating magnetic switch MS6R that are connected in series.

A node 55 is provided on a line extending from the bus G and through an operation switch PB. Between the node 55 and the bus P, a start auxiliary circuit l8 is disposed, which comprises a parallel circuit comprising a contact "b" CR-6c3 of the 3rd counter set relay CR6c, a contact "a" CR-S7 of the grinding change relay CRS and a contact "b" CR-R1 of a counter reset relay CRR; a parallel circuit comprising a contact "b" CR-6b3 of the 2nd counter set relay CR6b, a contact "b" CR-S8 of the grinding change relay CRS and a contact "a" CR-R2 of the counter reset relay CRR; and a 1st relay CR1 being connected in series with said two parallel circuits. Symbol CR-1a represents a self-maintaining contact of the 1st relay CR1.

Between the node 55 and the bus P, a contact "b" LS-B1 of the counting limit switch LS-B shown in FIG. 1 and a 2nd relay CR2 are connected in series. Symbol CR-2 represents a self-maintaining contact of the 2nd relay.

It is to be noted that said counting limit switch LS-B is provided with three contacts "a" LS-B2, LS-B3 and LS-B4 in addition to the contact "b" LS-B1.

In parallel with said 2nd relay CR2, a carriage-positioning circuit l9 is disposed, which comprises the contact "a" LS-B2 of the counting limit switch LS-B and the 3rd relay CR3 that are connected in series. Symbol CR-3d represents a self-maintaining contact of the 3rd relay CR3.

Description will now be made of a carriage starting circuit l10 and a grinding wheel advance starting circuit l11.

A node 56 is provided on a line extending from the bus G and through a contact "b" CR-3e of the 3rd relay CR3 and a contact "a" CR-1b of the 1st relay CR1. The 4th relay CR4 is connected between the node 56 and the bus P to form the carriage starting circuit l10.

Between the bus G and a node 57, a contact "a" CR-3f of the 3rd relay CR3, a contact "a" CR-8a of an 8th relay CR-8, and a contact "b" CR-7a of a 7th relay CR7 are connected in series. Between the node 57 and the bus P, a push-button switch PB-B which is a means for manually extending the grinding stroke, the contact "a" LS-B3 of the counting limit switch LS-B, contact "b" TR-1 of a 1st timer TR1, and the grinding wheel advance starting relay CRC are connected in series to form the grinding wheel advance starting circuit l11.

The 1st timer TR1 is for setting the cutting time.

A diode D2 is connected in a forward direction between the node 56 and the node 57. A contact "a" LS-A2 of the limit switch LS-A is connected between the node 57 and a node which is provided between the contact "a" CR-3f of the 3rd relay CR3 and the contact "a" CR-8a of the 8th relay CR8. A contact "b" CR-R3 of the counter reset relay CRR and the 8th relay CR8 are connected in series between the node 57 and the bus P.

Description will now be made of a driving circuit, etc. of the counter or the stepping relay for counting the number of times the carriage is reciprocated to ensure proper grinding operation.

Figure 11:
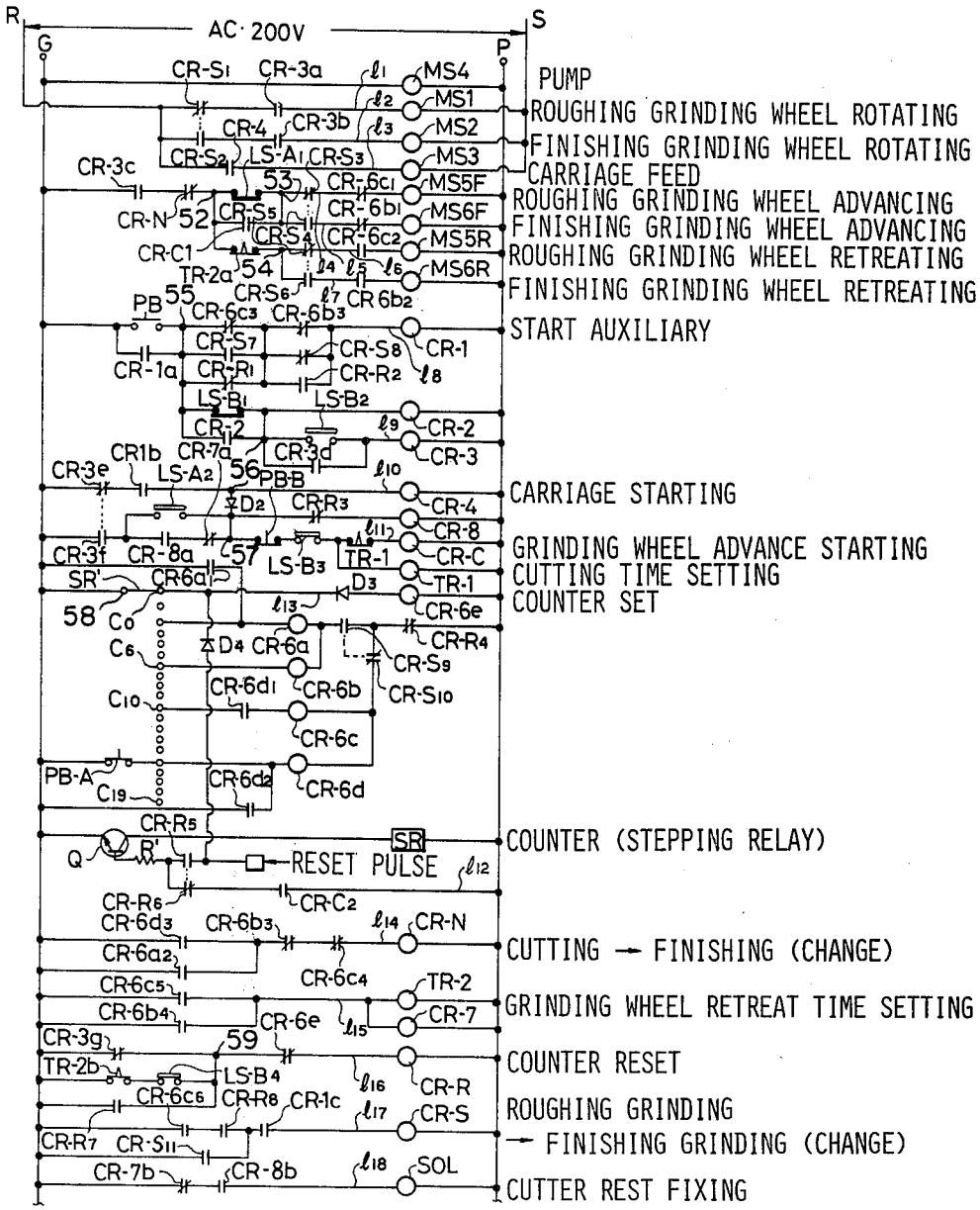
FIG. 11 is an electric circuit diagram showing an example of a sequential-control circuit used in the 1st Embodiment of the present invention.

In FIG. 11, symbol SR represents the stepping relay, SR' is a movable contact, and C0, C1, C2—are counting contacts. The stepping relay SR has 20 counting contacts, for instance, and returns to the first contact C0 after counting 20. The number of times of cutting (the number of times of carriage reciprocation for cutting operation as the first half of the roughing grinding process) can be arbitrarily set within 20, and in FIG. 11 it is set at 15.

The stepping relay SR is connected, through a switching element Q, between the buses P and G. Between the bus P and a base control terminal of the switching element Q, a contact "a" CR-C2 of the grinding wheel advance starting relay CRC, a contact "b" CR-R6 of the counter reset relay CRR, and a resistance R' are connected in series to form a stepping relay driving circuit l12. The line with a contact "a" CR-R5 of the counter reset relay CRR is an input line for reset pulses.

A common contact 58, with which the movable contact 47' is connected, is connected with the bus G, and the bus P is connected, through a 5th counter set relay CR6e and a diode D3 in a forward direction, with the counting contact C0 to form a counter set circuit l13.

Symbols CR6a, CR6b, CR6c and CR6d respectively represent 1st, 2nd, 3rd and 4th counter set relays. The number of times of cutting can be arbitrarily set by setting the 4th counter set relay CR6d to one of the counting contacts C0 to C19. Symbol CR-6d2 represents a self-maintaining contact of the 4th counter set relay CR6d.

Furthermore, control circuits l14 to l18 as follows are disposed between the buses P and G.

A cutting-finishing change circuit l14 comprises a contact "a" 6R-6d3 of the 4th counter set relay CR6d and a contact "a" CR-6a2 of the 1st counter set relay CR6a being connected in parallel with one another; and a contact "b" CR-6b3 of the 2nd counter set relay CR6b, a contact "b" CR-6c4 of the 3rd counter set relay CR6c, and the cutting-finishing change relay CRN being connected in series with said parallel circuit.

A grinding wheel retreat time-setting circuit l15 comprises a contact "a" CR-6c5 of the 3rd counter set relay CR6c and a contact "a" CR-6b4 of the 2nd counter set relay CR6b being connected in parallel with one another; the 2nd timer TR2 and the 7th relay CR7 being connected in parallel with one another; the former parallel circuit being connected in series with the latter parallel circuit.

A counter reset circuit l16 comprises a contact "b" CR-3g of the 3rd relay CR3; a series circuit comprising a contact "a" TR-2b of the 2nd timer TR2 and the contact "a" LS-B4 of the counting limit switch LS-B; and a contact "a" CR-R7 of the 7th relay CR7; these three being disposed so as to form a parallel circuit having a node 59; and a contact "b" CR-6e of the 5th counter set relay CR6e and the counter reset relay CRR being connected in series with the node 59.

A roughing grinding, finishing grinding change circuit l17 comprises a contact "a" CR-6c6 of the 3rd counter set relay CR6c and a contact "a" CR-Rs of the counter reset relay CRR being connected in series with one another; a contact "a" CR-S11 of the grinding change relay CRS being connected in parallel with said series circuit; and a contact "a" CR-1c of the 1st relay CR1 and the grinding change relay CRS being connected in series with said parallel circuit.

A cutter rest fixing circuit l18 is a series circuit comprising a contact "b" CR-7b of the 7th relay CR7, a contact "a" CR-8b of the 8th relay CR8, and the solenoid SOL, the position of which is shown in FIG. 5, etc.

Symbol PB-A in said counter circuit (stepping relay circuit) represents a push-button switch as a means for manually reducing the number of reciprocations of the carriage 3. When it is found necessary to stop the roughing grinding operation before the carriage 3 completes a preset number of reciprocations, the push-button switch PB-A reduces the roughing grinding operation by jumping the movable contact SR' over the counting contacts.

The cutter grinding machine, in the 1st Embodiment of the present invention, automatically performs the roughing grinding operation and the finishing grinding operation by sequential control as described below.

Figure 12:
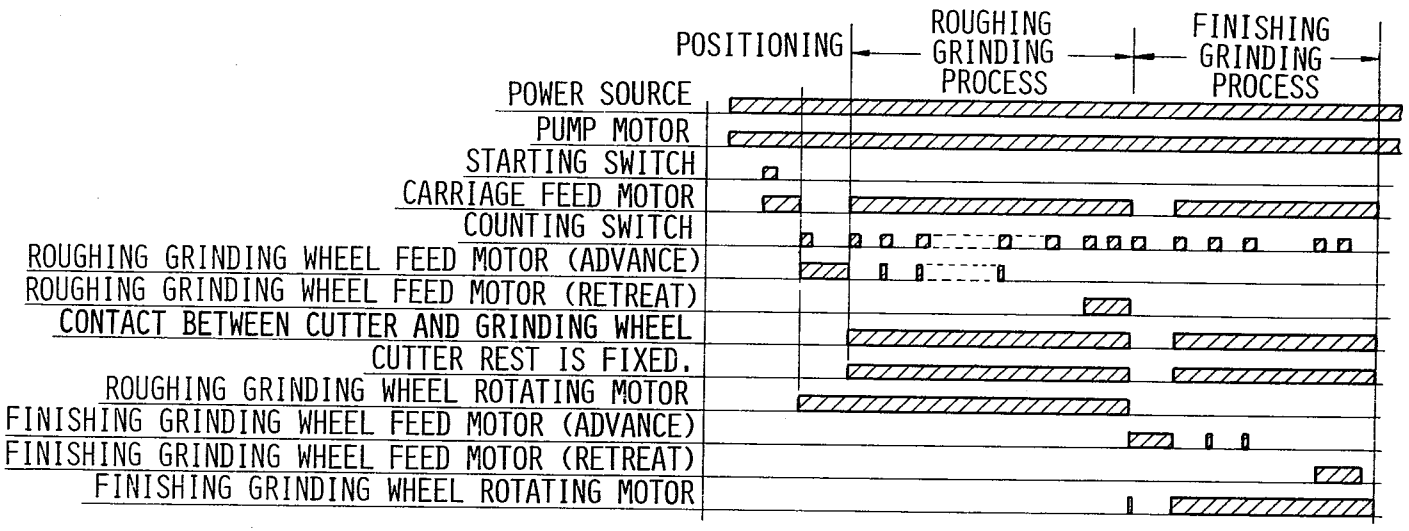
FIG. 12 is a time chart showing the sequential operation thereof.

The sequentially controlled operation of the cutter grinding machine shown in FIGS. 1 to 6 will now be described with reference to FIGS. 10 to 12.

First, a cutter 10 is fixed on the cutter rest 7 by tightening the clamping bolts 9, and the inclination of the cutter rest 7 is adjusted by turning the handle shaft 24 of the cutter angle-adjusting mechanism so that the cutter 10 may be ground and finished at a desired angle.

When the power switch SW is turned on, the pump-driving magnetic switch MS4 is turned on and cooling water is supplied through a water nozzle (not shown) to the ground surface 10' of the cutter 10.

When the operation switch PB is pushed next, the start auxiliary circuit l8 is closed, the self-maintaining contact CR-1*a* of the 1st relay CR1 is turned on, and the 1st relay CR1 maintains itself. As the self-maintaining contact CR-1*a* is turned on, the 2nd relay CR2 is excited and its contact "a" CR-2 is turned on. And this state is maintained.

By the self-maintenance of the start auxiliary circuit l8 and the 2nd relay circuit, the carriage 3 is positioned as follows:

First, the carriage-starting circuit l10 is closed by the excitation of the 1st relay CR1. Secondly, the 4th relay CR4 is excited by the closing of the carriage starting circuit l10 and the carriage feed circuit l3 is closed. Thirdly, the carriage feed motor M3 is started by the excitation of the 3rd magnetic switch M3. Then, the carriage 3 starts a lateral movement.

By the first action of the counting limit switch LS-B caused by the movement of the carriage 3, the 3rd relay CR3 in the carriage-positioning circuit l9 is excited, and maintains itself. By the excitation of the 3rd relay CR3, the contact "b" CR-3*e* in the carriage-starting circuit l10 is turned off, and the carriage-starting circuit l10 is opened. Therefore, the carriage 3 is stopped when it has come to a fixed position where it actuates the counting limit switch LS-B. Thus the carriage 3 is positioned, and is now ready for subsequent operation.

At the same time of positioning of the carriage 3, circuits relating to the roughing grinding wheel G1 operate as follows:

By the excitation of the 3rd relay CR3, both the 1st magnetic switch MS1 in the roughing grinding wheel rotating circuit l1 and the roughing grinding wheel advance driving magnetic switch MS5F in the roughing grinding wheel advancing circuit l4 are excited. Then, the roughing grinding wheel rotating motor M1 starts rotation, and the roughing grinding wheel G1 starts advancing toward the ground surface 10' of the cutter 10.

The circuits relating to the roughing grinding wheel G1 may be adapted so that the roughing grinding wheel rotating motor M1 does not rotate the roughing grinding wheel G1 until the roughing grinding wheel G1 comes into contact with the ground surface 10' of the cutter 10 and stops advancing as described below. The same thing can be said about the relation between the finishing grinding wheel rotating motor M2 and the finishing grinding wheel feed motor M6.

When the roughing grinding wheel G1 comes into contact with the ground surface 10' of the cutter 10, the cutter 10 turns counterclockwise (in FIG. 5) a little with the cutter rest 7 to retreat its ground surface 10' slightly. The limit switch LS-A is actuated by the turning of the cutter rest 7, and its contact "b" LS-A1 is turned off. Now the roughing grinding wheel advancing circuit l4 is closed. Thus, the roughing grinding wheel feed motor M5 stops rotating, and the roughing grinding wheel G1 stops advancing.

By the action of the limit switch LS-A, its contact "a" LS-A2 is turned on, and the 8th relay CR8 is escited. The cutter rest fixing circuit l18 is closed. Then, the solenoid SOL is excited, and attracts and fixes the cutter rest 7. Now the cutter grinding machine is ready for roughing grinding operations.

At the same time the solenoid SOL is excited, the carriage starting circuit l10 is closed, and then the carriage feed circuit l3 is closed. Therefore, the carriage feed motor M3 starts rotation, and the carriage 3 starts reciprocating through said carriage-reciprocating mechanism comprising the changeover lever 43, the stroke control members 46,46', etc. As the carriage 3 reciprocates, the switch-actuating lever 47 turns the counting limit switch LS-B on and off. Each time the counting limit switch LS-B is turned on, the grinding wheel advance starting circuit l11 is closed. At the same time this circuit is closed the 1st timer TR1 for setting the cutting time operates to control the closed time of the grinding wheel advance-starting circuit l11. The cutting time set by the 1st timer TR1 is as short as 0.03 to 0.3 second for instance. Therefore, the roughing grinding wheel advancing circuit l4 is closed each time only for a period of the cutting time set by the 1st timer TR1. Each time the roughing grinding wheel advancing circuit l4 is thus closed, the roughing grinding wheel feed motor M5 moves the roughing grinding wheel G1 slightly forward to perform the cutting operation (roughing grinding operation).

Each time the griding wheel advance-starting circuit l11 is closed as mentioned above, the stepping-relay driving circuit l12 is closed, and the stepping action (counting action) of the counting contacts C1, C2—is performed.

In an example shown in FIG. 11, the count number is set at 15. When the movable contact SR' has stepped to the counting contact C15 (that is, when the carriage 3 has reciprocated 15 times), the 4th counter set relay CR6*d* is excited, the cutting-finishing change circuit l14 is closed, and then the roughing grinding wheel advancing circuit l4 is opened. Thus, the roughing grinding wheel G1 cutting operation stops. By the excitation of the 4th counter set relay CR6*d*, the contact "a" CR-6*d*1 connected with the counting contact C10 is turned on.

Even after the cutting operation is completed, the cutter 10 still continues to reciprocate and the roughing grinding wheel G1 remains in the final cutting position. Therefore the roughing grinding wheel G1 now performs finishing as the second half of the roughing grinding process.

Also in said finishing, the counting limit switch LS-B continues to be turned on and off, and the stepping relay SR performs its stepping action. This stepping action is continued until the movable contact SR' passes through the final counting contact C19 and the starting contact C0, and comes to the 10th counting contact C10, that is, until it goes through another 15 counting contacts. When the movable contact SR' comes to the counting contact C10, the 3rd counter set relay CR6*c* is excited, the cutting-finishing change circuit l14 is opened, and then the roughing grinding wheel advancing circuit l4 is closed. With the excitation of said 3rd counter set relay CR6*c*, the roughing grinding wheel retreating circuit l6 is closed, and the roughing grinding wheel retreating magnetic switch MS5R is actuated. Thus, the roughing grinding wheel G1 starts retreating. The retreat thereof continues for a period of time preset by means of the 2nd timer.

Said finishing in the roughing grinding process may be omitted if the depth of cut in said cutting operation is very small.

When the counting limit switch LS-B is turned on during the operation of the 2nd timer TR2, the counter reset circuit l16 closes and maintains itself. Then, the contact CR-R5 of the counter reset relay CRR is turned on, and a reset pulse is put into the switching element Q to return the movable contact SR′ of the stepping relay SR to the starting contact C0. The 5th counter set relay CR6*e* is excited by the resetting operation, and the self-maintenance of the counter reset circuit l16 is released. Thus, the stepping relay SR is returned to the initial state ready for operation.

When the counter reset relay CRR has operated as mentioned above, the grinding change relay CRS is excited and maintains itself.

Therefore, all the contacts "a" in the contacts CR-S1 to CR-S10 of the grinding change relay CRS are turned on.

Thereby the roughing grinding wheel rotating motor M1, etc. are stopped and the fixing of the cutter rest 7 is released. Now the roughing grinding process is concluded.

At said conclusion of the roughing grinding process, the carriage feed M3 is stopped when the counting limit switch LS-B is actuated. Therefore, said positioning of the carriage 3 is automatically performed so that the carriage 3 is ready for the beginning of a subsequent finishing grinding process.

By said operation of the grinding change relay CRS, control circuits relating to the finishing grinding wheel G2, such as the finishing grinding wheel rotating circuit l2 and the finishing grinding wheel advancing circuit l5, start to operate. The finishing grinding process is the same in the sequence of operation as the roughing grinding process as shown in the time chart in FIG. 12 except that in the finishing grinding process the number of times of cutting is two and the number of times of finishing is four because the required number of the carriage reciprocations in the finishing grinding process is smaller than in the roughing grinding process.

When it is necessary to stop the finishing grinding operation (particularly the cutting operation therein) before the carriage 3 completes a preset number of reciprocations, the push-button switch PB-A is pushed to reduce the roughing grinding operation by jumping the movable contact SR′ over the counting contacts. This avoids the unnecessary reciprocation of the carriage 3.

When it is necessary to continue the grinding operaton even after the carriage 3 completes a preset number of reciprocations, the push-button switch PB-B is continuously pushed. While it is being pushed, the stepping relay SR discontinues its stepping action to extend the grinding operation.

After the conclusion of all the grinding processes, the start auxiliary circuit l8 is opened, and the operation of all the control circuits is stopped.

Some variations of the proximate position-detecting means usable in the cutter grinding machine embodying the present invention will now be described with reference to FIGS. 3 to 22.

In the variations described below, members or portions which are the same as, or equivalent to, those shown in FIGS. 1 to 6 are represented by the same numberals or symbols.

Figure 13:
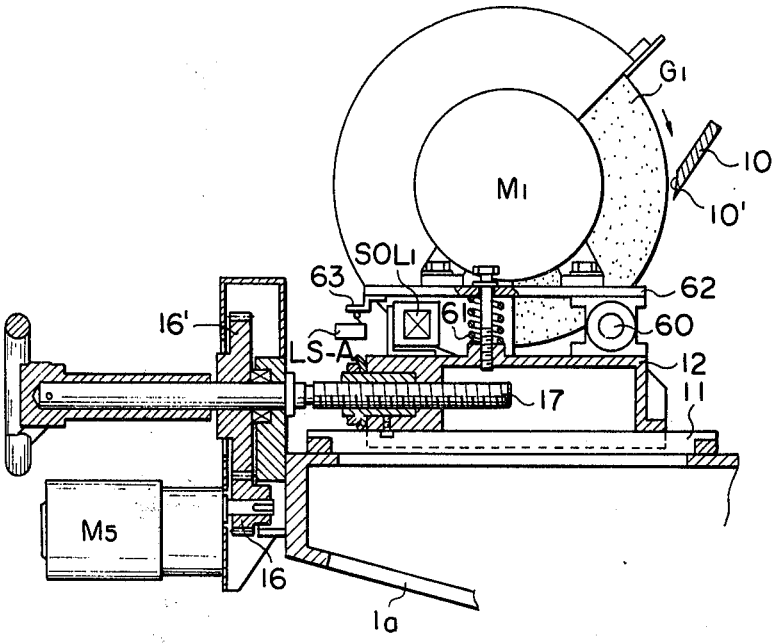
FIGS. 13 to 19 show variations of a proximate position-detecting means used in FIG. 1 or 7.
Figure 14:
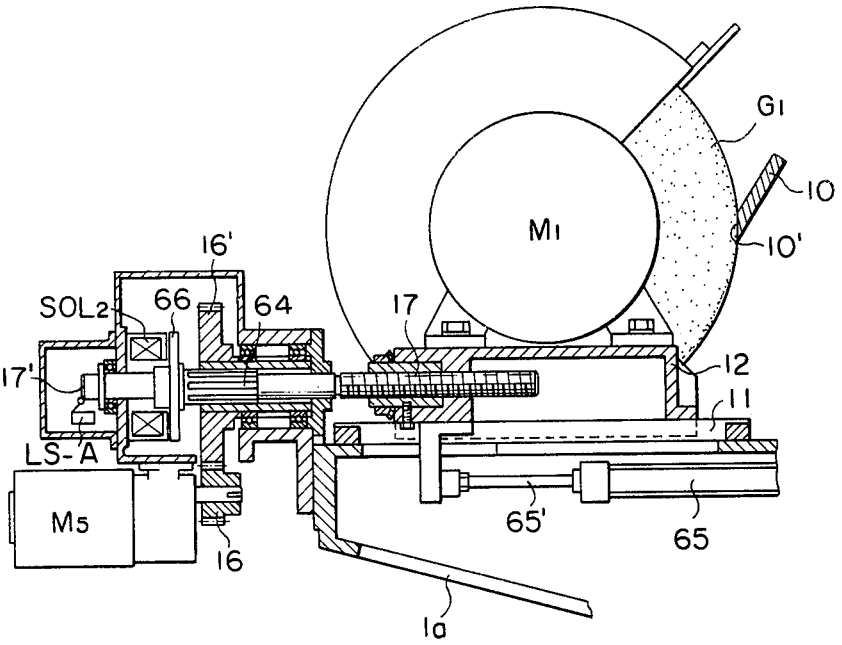

FIGS. 13 and 14 show examples in which the grinding wheel is adapted to retreat to actuate the limit switch LS-A at the moment when the grinding wheel contacts the ground surface 10′ of the cutter 10.

In an example shown in FIG. 13, a mount 62 is disposed over the slide rest 12 of the roughing grinding wheel G1 (the following description applies also to the finishing grinding wheel G2) so as to turn within a suitable range on a rotatable shaft 60. Numeral 61 represents a balancing (pushing) spring. The roughing grinding wheel rotating motor M1 is fixed on said mount 62. As a proximate position-detecting means, a switch-actuating member 63 is fixed to the free end of the mount 62, and the limit switch LS-A corresponding thereto is fixed to the slide rest 12. Furthermore, a solenoid SOL1 is disposed on the slide rest 12 so as to be proximate to the limit switch LS-A.

When the roughing grinding wheel G1 comes into contact with the ground surface 10′ of the cutter 10, the mount 62 is turned counterclockwise and actuates the limit switch LS-A. At the same time, the roughing grinding wheel feed motor M5 is stopped, and the solenoid SOL1 attracts and fixes the mount 62.

In an example shown in FIG. 14, the threaded feed shaft 17 is provided with a splined portion 64 through which the threaded feed shaft 17 is related to the roughing grinding wheel feed motor M5.

As a proximate position-detecting means, the limit switch LS-A is disposed in a position corresponding to one end 17′ of the threaded feed shaft 17. To fix the retreated state of the threaded feed shaft 17 (and therefore the roughing grinding wheel G1), a rotatable plate 66 is attached to the threaded feed shaft 17, and a solenoid SOL2 is disposed in a position corresponding to the plate 66.

When the roughing grinding wheel G1 comes into contact with the ground surface 10′ of the cutter 10, the threaded feed shaft 17 is slightly retreated through its splined portion 64, and the roughing grinding wheel feed motor M5 is stopped. At the same time, the solenoid SOL2 is excited to fix the retreated state of the threaded feed shaft 17.

Numeral 65 represents a balancing cylinder, and numeral 65′ represents a piston rod thereof. The balancing cylinder 65 and the piston rod 65′ thereof are disposed so as to give the slide rest 12 a tendency to move forward.

Figure 15:
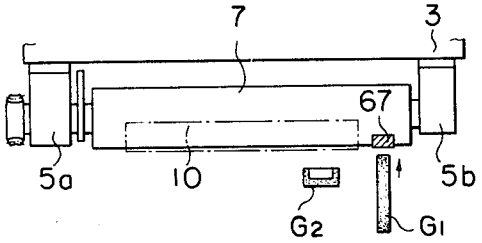

In an example shown in FIG. 15, the cutter rest 7 is proved with a contact piece 67 which contacts the roughing grinding wheel G1 or the finishing grinding wheel G2. The contact piece 67 serves to prevent the grinding wheel from cutting into the cutter 10, which may cause damage thereto such as breaks or scorching.

The contact piece 67 in this example serves as a protector of the cutter 10 as mentioned above. The contact piece 67 may be replaced by a switch such as a limit switch (not shown) which serves both as a protector and a detecting switch, and makes it possible to detect the proximity between the grinding wheel and the cutter 10 without bringing the grinding wheel into direct contact with the cutter 10. This may be referred to as a proximate position-detecting means of the non-contact type.

Figure 16:
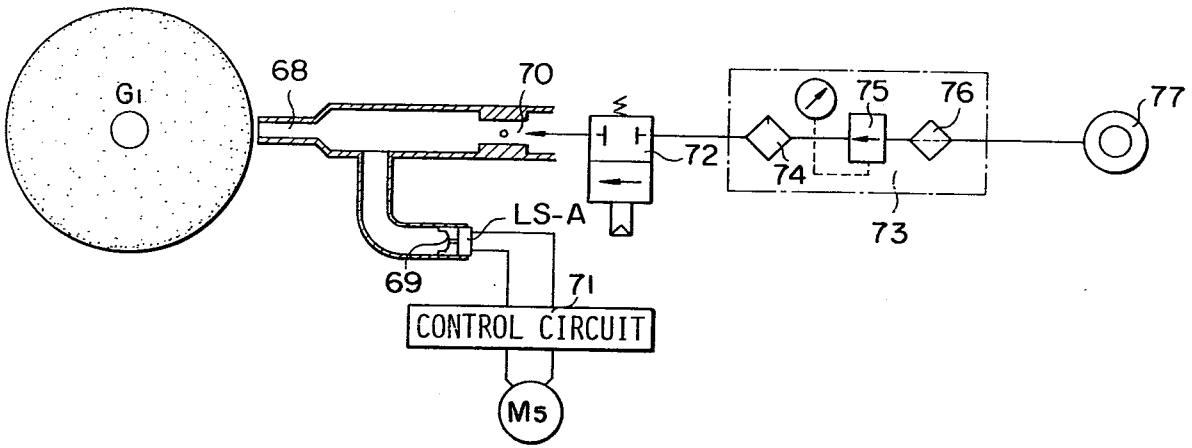

FIG. 16 shows another proximate position-detecting means of the non-contact type which comprises an air blowing nozzle 68 through which air is blown to the roughing grinding wheel G1, a diaphragm means 69 for detecting air back-pressure, and the limit switch LS-A corresponding to the diaphragm means 69. When the roughing grinding wheel G1 has advanced to a fixed proximate position, air back-pressure produced thereby actuates the limit switch LS-A to stop the roughing grinding wheel feed motor M5.

In FIG. 16, numeral 70 represents a throttle valve, 71 is a control circuit, 72 is an electromagnetic changeover valve, 73 is an air regulating unit, 74 is a lubricator, 75 is a regulator, 76 is a filter, and 77 is a compressor.

In this example, it is possible to adjust the clearance between the roughing grinding wheel G1 and the air blowing nozzle 68, that is, the position proximate to the cutter 10 at which the roughing grinding wheel G1 stops, by means of the regulator 75 included in the air regulating unit 73.

Figure 17:
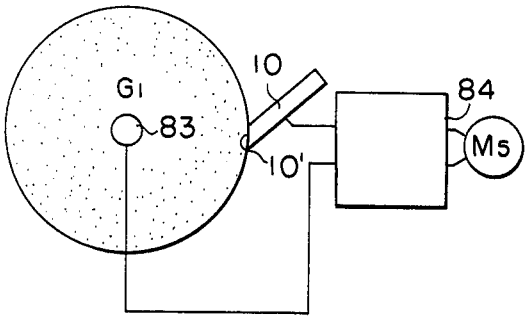
Figure 18A:
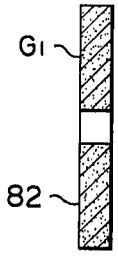
Figure 18B:
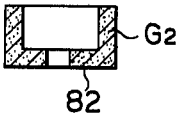

FIGS. 17 and 18(A) and 18(B) show a proximate position-detecting means of the contact type, in which the grinding wheels G1 and G2 are covered with an electrically conductive film 82, and the shaft 83 of the grinding wheel G1 (and the grinding wheel G2) and the cutter 10 are adapted to serve as a pair of electrodes. When the grinding wheel G1 has come into contact with the ground surface 10' of the cutter 10, an electric circuit connecting the two electrodes is closed, and the roughing grinding wheel feed motor M5 is thereby stopped through a control circuit 84.

Figure 19:
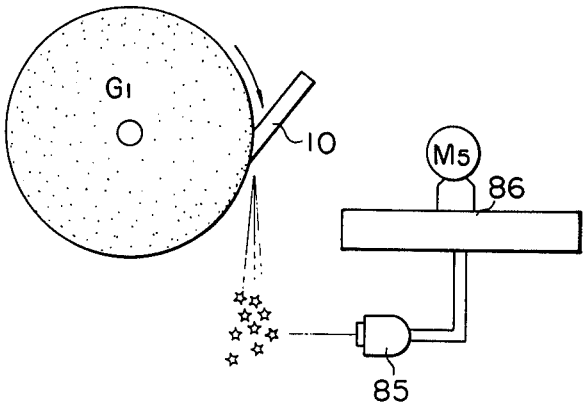

FIG. 19 shows another proximate position-detecting means of the contact type, in which sparks emitted when the rotating grinding wheel G1 contacts the cutter 10 are detected by a light sensor 85, and a signal thereof stops the roughing grinding wheel feed motor M5 through a control circuit 86.

Figure 20:
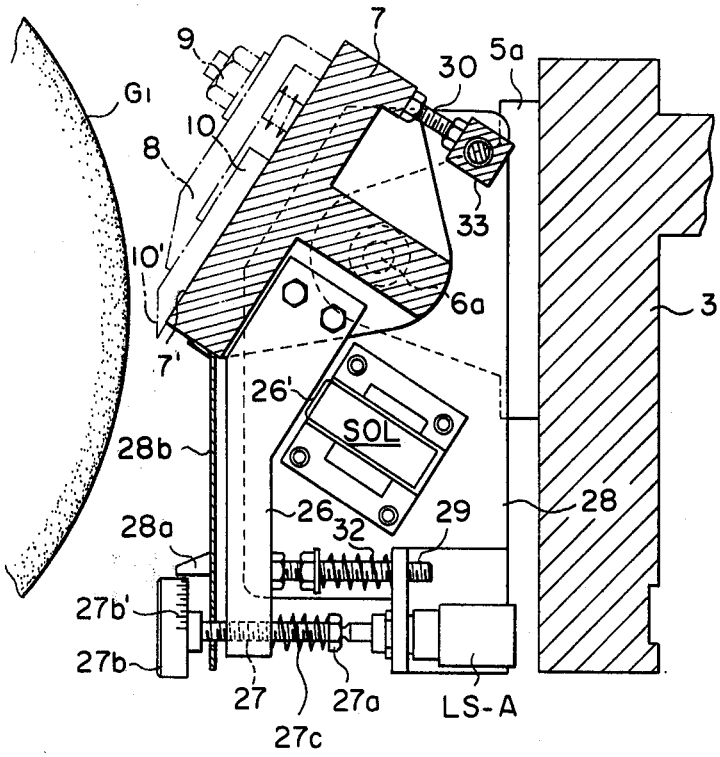
FIG. 20 is a sectional view, similar to FIG. 5, showing a proximate postion-detecting means with a fine-adjustment device for a grinding wheel position used in FIG. 7.
Figure 21:
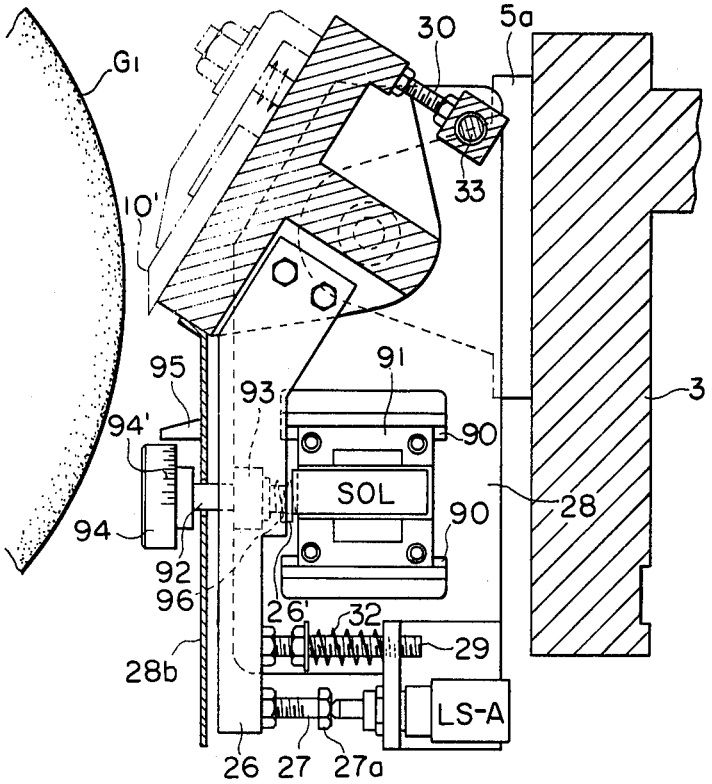
FIG. 21 is a sectional view of a variation thereof.
Figure 22:
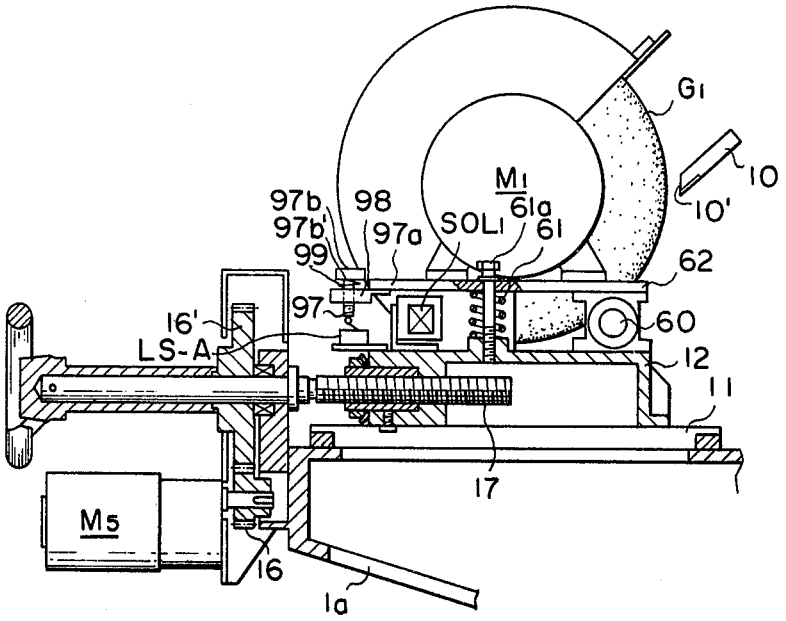
FIG. 22 is a partly sectional side view of another variation thereof.

In examples shown in FIGS. 20 to 22, a proximate position-detecting means is provided with a fine adjustment device for adjusting the relation between a detecting position of the proximate position-detecting means and a position thereof in which it is fixed by a fixing means, so as to obtain a desirable clearance between the grinding wheel and the cutter.

Figure 23A:
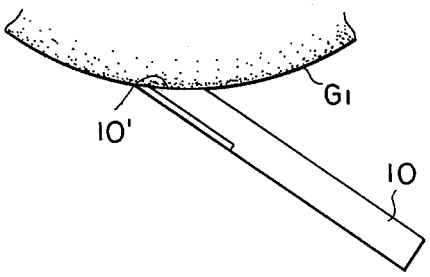
FIG. 23 (A) and FIG. 23 (B) are side views showing a cutter being ground.
Figure 23B:
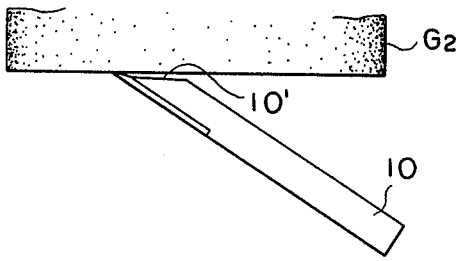

In the grinding operation of the cutter 10, first the face of the cutter 10' is ground and breaks on the cutting edge are removed by means of the disc-shaped roughing grinding wheel G1, and then the cutting edge is sharpened by means of the cup-shaped finishing grinding wheel G2 as shown in FIG. 23(A) and FIG. 23(B). The cutting quality of the cutter 10 depends mostly upon said sharpening of the cutting edge by the finishing grinding wheel G2.

Therefore, an object of the examples shown in FIGS. 20 to 22 is to sharpen the cutting edge more precisely by making the position of the grinding wheel, in relation to the position of the ground surface 10' of the cutter 10, more accurate.

In examples shown in FIGS. 20 and 21, a fine adjustment device is attached to the proximate position-detecting means shown in FIG. 5.

Referring first to an example shown in FIG. 20, the switch-actuating member 27 is in threaded engagement with the stay 26 so as to pass through it. One end of the switch-actuating member 27 is provided with an actuating head 27*a* corresponding to the limit switch LS-A. The other end thereof passes through a cover plate 28*b* in front of the stay 26, and is provided with a knob 27*b*.

The knob 27*b* is provided on its circumference with graduation 27*b'*, and a zero mark 28*a* corresponding thereto is provided on the cover plate 28*b* so that the degree of turning of the knob 27*b*, that is, the quantity of adjustment of the switch actuating member 27, can be identified.

The clearance between the switch actuating member 27 and the limit switch LS-A is adjusted within a range of 0 to about 0.2 mm.

Numeral 27*c* represents a spring disposed between the actuating head 27*a* and the stay 26 so as to prevent the switch actuating member 27 from becoming loose.

At the beginning of the operation, as described above, the roughing grinding wheel G1 stops advancing, and the cutter rest 7 is fixed through the attracted surface 26' of the stay 26, thus the cutter 10 being fixed in position.

At this time, the clearance between the roughing grinding wheel G1 and the ground surface 10' of the cutter 10 (the distance which the ground surface 10'' moves when the stay 26 of the cutter rest 7 is attracted by the solenoid SOL after the limit switch LS-A is actuated) is less than the distance which the roughing grinding wheel G1 continues to move by the inertia of the slide rest 12 after the limit switch LS-A is actuated. Said clearance varies according to machines because of differences in conditions such as the response of the roughing grinding wheel feed motor M5 and the frictional resistance of the feed guides 11. Said clearance varies also because the distance which the ground surface 10' withdraws in relation to the roughing grinding wheel G1 differs according to the angle of the cutter rest 7, which angle depends upon the nose angle of the cutter 10.

In this example, the position of the switch actuating member 27 is adjusted in advance with relation to the limit switch LS-A by means of the knob 27*b*. If said clearance between the roughing grinding wheel G1 and the ground surface 10' of the cutter 10 is too large, the knob 27*b* is turned in the direction of moving the switch actuating member 27 away from the limit switch LS-A. If said clearance is too small, the knob 27*b* is turned in the direction of moving the switch actuating member 27 toward the limit switch LS-A.

In an example shown in FIG. 21, said clearance between the roughing grinding wheel G1 and the ground surface 10' of the cutter 10 is adjusted by changing the positional relation between the solenoid SOL and the stay 26 attracted thereby, and not by changing the positional relation between the switch actuating member 27 and the limit switch LS-A.

In FIG. 21, numeral 90 represents slide guides disposed on the support plate 28 in the direction of attraction of the solenoid SOL. On the slide guides 90, a supporting plate 91 of the solenoid SOL is slidably mounted. Numeral 92 represents an adjusting shaft supported rotatably but not axially movable in a bearing 93 disposed in a front portion of the support plate 28. One end of the adjusting shaft 92 is in threaded engagement with said supporting plate 91 so that the rotation of the adjusting shaft 92 moves the solenoid SOL so as to change the clearance between the solenoid SOL and the attracted surface 26' of the stay 26.

The other end of the adjusting shaft 92 passes through the cover plate 28*b* of the stay 26, and is provided with a knob 94.

Numeral 94' represents graduation provided on the circumference of the knob 94. Numeral 95 represents a zero mark. Numeral 96 represents a spring fitted around the adjusting shaft 92 and between the supporting plate 91 and the bearing 93 so as to prevent the adjusting shaft 92 from becoming loose.

This example is not designed to adjust the positional relation between the switch-actuating member 27 and the limit switch LS-A, but it is designed to adjust said distance which the ground surface 10' moves when the stay 26 of the cutter rest 7 is attracted by the solenoid SOL after the limit switch is actuated. Therefore, it is possible to adjust said clearance between the roughing grinding wheel G1 and the ground surface 10' of the cutter 10 by changing the above-mentioned distance by means of the knob 94.

In an example shown in FIG. 22, a fine adjustment device is added to the proximate position-detecting means shown in FIG. 13.

In FIG. 22 numeral 61*a* represents a stop bolt, one end thereof being in threaded engagement with the slide rest 12 and the other end thereof being in engagement with the mount 62. The stop bolt 61*a* limits the upward turning of the mount 62, and holds the roughing grinding wheel G1 in place when the solenoid SOL1 is not excited.

A switch-actuating member 97 is in threaded engagement, through a support 98, with the mount 62, and is provided on one end thereof with an actuating head 97*a* corresponding to the limit switch LS-A.

The other end (upper end) of the switch-actuating member 97 is provided with a knob 97*b*. The knob 97*b* is provided on its circumference with graduations 97*b'*, and a zero mark (not shown) is provided on the mount 62 so that the degree of adjustment can be identified.

Numeral 99 represents a spring disposed between the actuating head 97*a* and the support 98.

In this example, said clearance between the roughing grinding wheel G1 and the ground surface 10' of the cutter 10 is adjusted on the part of the roughing grinding wheel G1 and independent of the angle of the cutter rest 7, unlike the example shown in FIG. 20. Therefore, the adjustment can be performed more easily and accurately.

2ND EMBODIMENT

In this embodiment, the roughing grinding wheel system and the finishing grinding wheel system are respectively provided with a 1st proximate position-detecting means and a 2nd proximate position-detection means, and only the finishing grinding wheel system is provided with a pressing means for pressing the finishing grinding wheel G2 against the ground surface 10' of the cutter 10 in the finishing grinding process so that pressing grinding operation is performed in place of said cutting operation.

The 2nd Embodiment differs from the 1st Embodiment in these points and therefore in having some additions to the sequential control circuit shown in FIG. 11. The mechanical designs shown in FIGS. 1 to 4 and FIGS. 6 to 8, as well as said counting system of the 1st Embodiment, may be applied to the 2nd Embodiment without modification.

As the 1st proximate position-detecting means for the roughing grinding wheel system, any of the means shown in FIGS. 13 to 19 or the means with the fine adjustment device shown in FIG. 22 may be used without moidfication.

Therefore, description will be made mainly of the 2nd proximate position-detecting means, the pressing means, and the additional portions of the sequential control circuit. First, an example of the 2nd proximate position-detecting means and pressing means will be described with reference to FIG. 24(A) and FIG. 24(B).

The pressing means is added to the 2nd proximate position-detecting means of the finishing grinding wheel system as follows: A spring containing unit 106, shaped like a hollow cylinder, is provided on the back side (the side opposite to the finishing grinding wheel G2) of the slide rest 14, and a movable piece 107, in threaded engagement with the threaded feed shaft 19, is slidably disposed in the spring containing unit 106. Between the movable piece 107 and one end of the spring containing unit 106, a coil spring 108 is disposed so as to push the movable piece 107 in the direction of retreat (the direction opposite to the advance of the finishing grinding wheel G2). On the opposite side of the movable piece 107, a spring force adjusting nut 109 is in threaded engagement with the spring containing unit 106. The force of the coil spring 108 applied to the movable piece 107 is adjusted by means of the spring force adjusting nut 109.

The threaded feed shaft 19 passes through the spring containing unit 106 and the spring force adjusting nut 109 so as to be movable in the axial direction.

A long opening 110 is bored through the top of the spring containing unit 106 in a position corresponding to the movable piece 107 and in the direction of movement of the movable piece 107. A stay 111 fixed to the movable piece 107 is inserted through the long opening 110, in the rear of the finishing grinding wheel rotating motor M2.

The stay 111 is provided, on its side facing the rear of the finishing grinding wheel rotating motor M2, with a limit switch LS-A', a solenoid SOL2, and an actuating lever 112 corresponding to them. The actuating lever 112 is rotatably supported on a pivot 112' of a suitable member (not shown) fixed on the stay 111.

A suitable actuating piece 113 corresponding to the actuating lever 112 is fixed to the rear of the finishing grinding wheel rotating motor M2.

When the movable piece 107 is moved toward the cutter 10 by rotating the finishing grinding wheel feed motor M6, the slide rest 14 is pushed through the coil spring 108 by the movable piece 107, and the finishing grinding wheel G2 is advanced toward the cutter 10. At this time, the movable piece 107 is in the rearmost position of the spring containing unit 106 and is in contact with the spring force adjusting nut 109, so that the limit switch LS-A' is not actuated. When the finishing grinding wheel G2 is brought into contact with the ground surface 10' of the cutter 10, the slide rest 14 stops advancing. After the slide rest 14 has stopped advancing the movable piece 107 advances in the spring containing unit 106 while compressing the coil spring 108. The advance of the movable piece 107 continues until the actuating piece 113 contacts the actuating lever 112 and this lever contacts and actuates the limit switch LS-A'. That is, the advance of the movable piece 107 is stopped when the power circuit of the finishing grinding wheel feed motor M6 is opened by the action of the limit switch LS-A'. At the same time, the solenoid SOL2 is excited through a contact (described later) of the limit switch LS-A', and attracts the actuating lever 112 to maintain the actuated state of the limit switch LS-A'.

When the rotation of the finishing grinding wheel feed motor M6 is stopped, as mentioned above, by the proximate position-detecting means comprising the limit switch LS-A', actuating lever 112, actuating piece 113, etc., the coil spring 108 is in a compressed state. The compression of the coil spring 108 serves as a force which presses the finishing grinding wheel G2 against the ground surface 10' of the cutter 10 during the finishing grinding operation.

Figure 25:
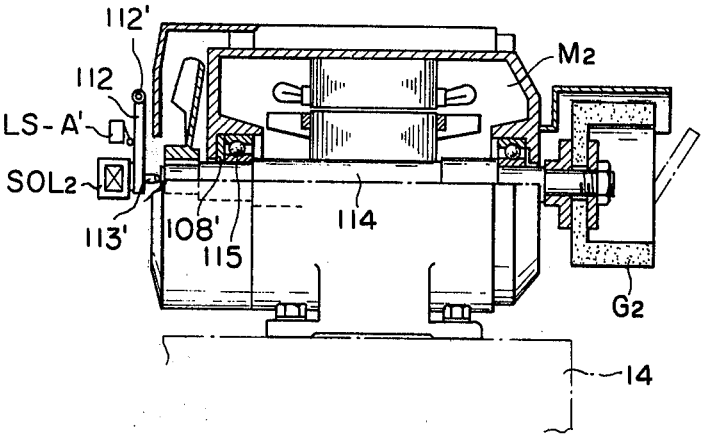
FIG. 25 is a partly sectional side view of a variation thereof.

Another example of the 2nd proximate position-detecting means and pressing means will be described with reference to FIG. 25.

This example utilizes the shaft 114 of the finishing grinding wheel rotating motor M2. A spring member 108', for instance a wave washer, is disposed between the shaft 114 and the body of the motor M2. The actuating lever 112 is provided on its side facing the rear end of the shaft 114 with an actuating piece 113', and on its opposite side with the limit switch LS-A' and solenoid SOL2.

When the finishing grinding wheel G2 has contacted the ground surface 10' of the cutter 10 and the shaft 114 of the motor M2 has stopped advancing, the body of the motor M2 still continues to be advanced against the elasticity of the spring member 108' by the threaded feed shaft 19. When the spring member 108' is compressed (about 0.1 to 0.2 mm) enough to obtain force necessary for pushing the finishing grinding wheel G2, the limit switch LS-A' is actuated to stop the finishing grinding wheel feed motor M6, amd at the same time the solenoid SOL2 is excited to maintain the actuated state of the limit switch LS-A'. In the finishing grinding operation (pressing grinding operation), the spring member 108' presses the finishing grinding wheel G2 through the shaft 114 against the ground surface 10' of the cutter 10. Numeral 115 represents a bearing.

The limit switch LS-A', the actuating lever 112, the solenoid SOL2, etc. are attached through suitable supporting members (not shown) to the body of the finishing grinding wheel rotating motor M2 or to the slide rest 14. This example is simpler in construction than said example shown in FIG. 24, because it does not need the movable piece 107, etc.

The sequential control circuit is the same as shown in FIG. 11 except that there are some additional portions for said 2nd proximate position detecting means. The additional portions will be described with reference to FIG. 26.

As mentioned before, the node 52 is provided on the line extending from the bus G and through the contact "a" CR-3*c* of the 3rd relay CR3 and the contact "b" CR-N of the cutting-finishing change relay CRN.

Figure 24:
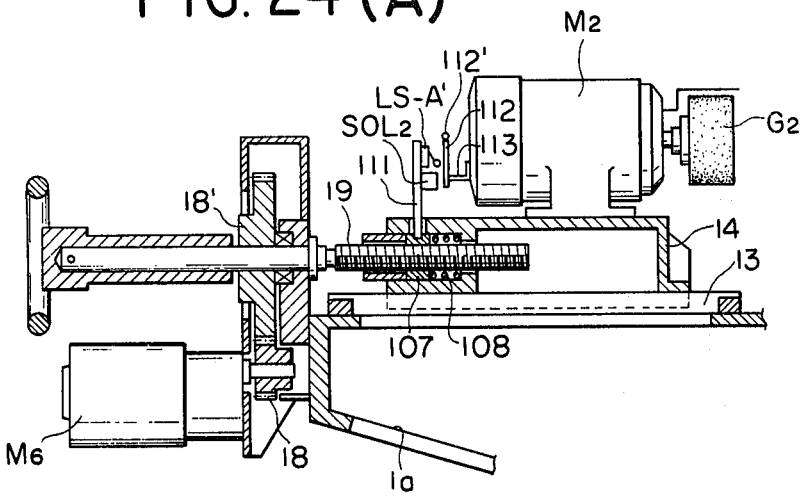
FIG. 24 (A) is a partly sectional side view showing a 2nd proximate position-detection means and a pressing means used in the 2nd Embodiment of the present invention.
Figure 24:
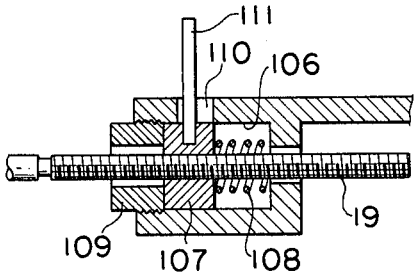

The contact "b" LS-A1 of the limit switch LS-A for the roughing grinding wheel G1, the position of which limit switch is shown in FIG. 13, etc., and a contact "b" LS-A1' of the limit switch LS-A' for the finishing grinding wheel G2, the position of which limit switch is shown in FIG. 24, etc., are connected in series with said node 52, and the node 53 is provided next to the contact "b" LS-A1'. Another series circuit comprising a contact "b" MS-2b of the 2nd magnetic switch MS2 and the contact "a" CR-C1 of the grinding wheel advance starting relay CRC is disposed between the nodes 52 and 53.

It is to be noted that the limit switches LS-A and LS-A' are respectively provided with contacts "a" LS-A2 and LS-A2' (mentioned below) in addition to said contacts "b" LS-A1 and LS-A1'.

Between the node 53 and the bus P, as mentioned before, the contact "b" CR-S3 of the grinding change relay CRS, the contact "b" CR-6*cl* of the 3rd counter set relay CR6*c*, and the roughing grinding wheel advance driving magnetic switch MS5F are connected in series to form the roughing grinding wheel advancing circuit l4.

A contact maintaining circuit 25 for the limit switch LS-A', comprising a contact "a" MS-2*c* of the 2nd magnetic switch MS2 and the solenoid SOL2 shown in FIG. 24 being connected in series with one another, is disposed in parallel with a roughing grinding wheel fixing circuit l18.

The operation of the 2nd Embodiment will now be described.

Because the roughing grinding process is the same as in the 1st Embodiment, description will be made only of the finishing grinding process in which the pressing grinding operation is performed.

The sequence of operations of the finishing grinding wheel system is about the same as that of the roughing grinding wheel system. However, the finishing grinding operation is substantially different from the roughing grinding operation in that the pressing grinding is performed in place of said cutting as mentioned above.

In the roughing grinding operation, the ground surface 10' of the cutter 10 is usually heavily ground as shown in FIG. 23 (A) to remove breaks in the cutting edge. In the finishing grinding operation, the object is to sharpen the cutting edge, and the quantity of grinding is usually as small as 0.1 to 0.2 mm. Therefore, in the finishing grinding process, said cutting operation is not necessary, and is replaced by the simple pressing grinding operation.

The operation of the 2nd Embodiment, comprising the proximate position-detecting means and pressing means shown in FIG. 24 (A) FIG. 24 (B), will now be described with reference also to FIG. 11.

With the positioning of the carriage 3 in the finishing grinding process, the 3rd relay CR3 is excited. By the excitation of the 3rd relay CR3, both the finishing grinding wheel rotating circuit l2 and the finishing grinding wheel advancing circuit l5 are closed. Then, the finishing grinding wheel rotating motor M2 starts rotating, and the finishing grinding wheel G2 starts advancing toward the cutter 10.

When the finishing grinding wheel G2 has contacted the ground surface 10' of the cutter 10, the coil spring 108 is compressed (0.1 to 0.2 mm) enough to obtain force necessary for pushing the finishing grinding wheel G2, and the limit switch LS-A' is actuated, the actuated state thereof being maintained. Therefore, the contact "b" of the limit switch LS-A' in the finishing grinding wheel advancing circuit l5 is turned off. With the excitation of the 2nd magnetic switch MS2, its contact "b" MS-2*b* is maintained in a state of being off. Thus, the finishing grinding wheel feed motor M6 stops advancing the finishing grinding wheel G2, and the finishing grinding wheel G2 is pressed against the cutter 10 only by the force of the coil spring 108.

With the maintenance of the limit switch LS-A', the carriage starting circuit l10 and then the carriage feed circuit l3 are closed in the same manner as in said roughing grinding process. Thus, the carriage 3 starts reciprocating, and the pressing grinding operation (finishing grinding operation) is performed. The number of times the carriage is to be reciprocated is preset, to 6 for instance. About six times of the carriage reciprocation is usually sufficient to obtain a required degree of grinding (0.1 to 0.2 mm) and to finish the cutter 10.

When the carriage 3 completes six times of reciprocation, the 2nd counter set relay CR6*b* in the counter circuit is excited, and the finishing grinding wheel retreating circuit l7, etc. are closed. Thus, the finishing grinding wheel G2 starts retreating, and the finishing grinding process is concluded. 3rd Embodiment.

In this embodiment, the grinding operation is regulated with respect to time, unlike in the 1st Embodiment in which it is regulated with respect to the number of times of said reciprocation.

Figure 27:
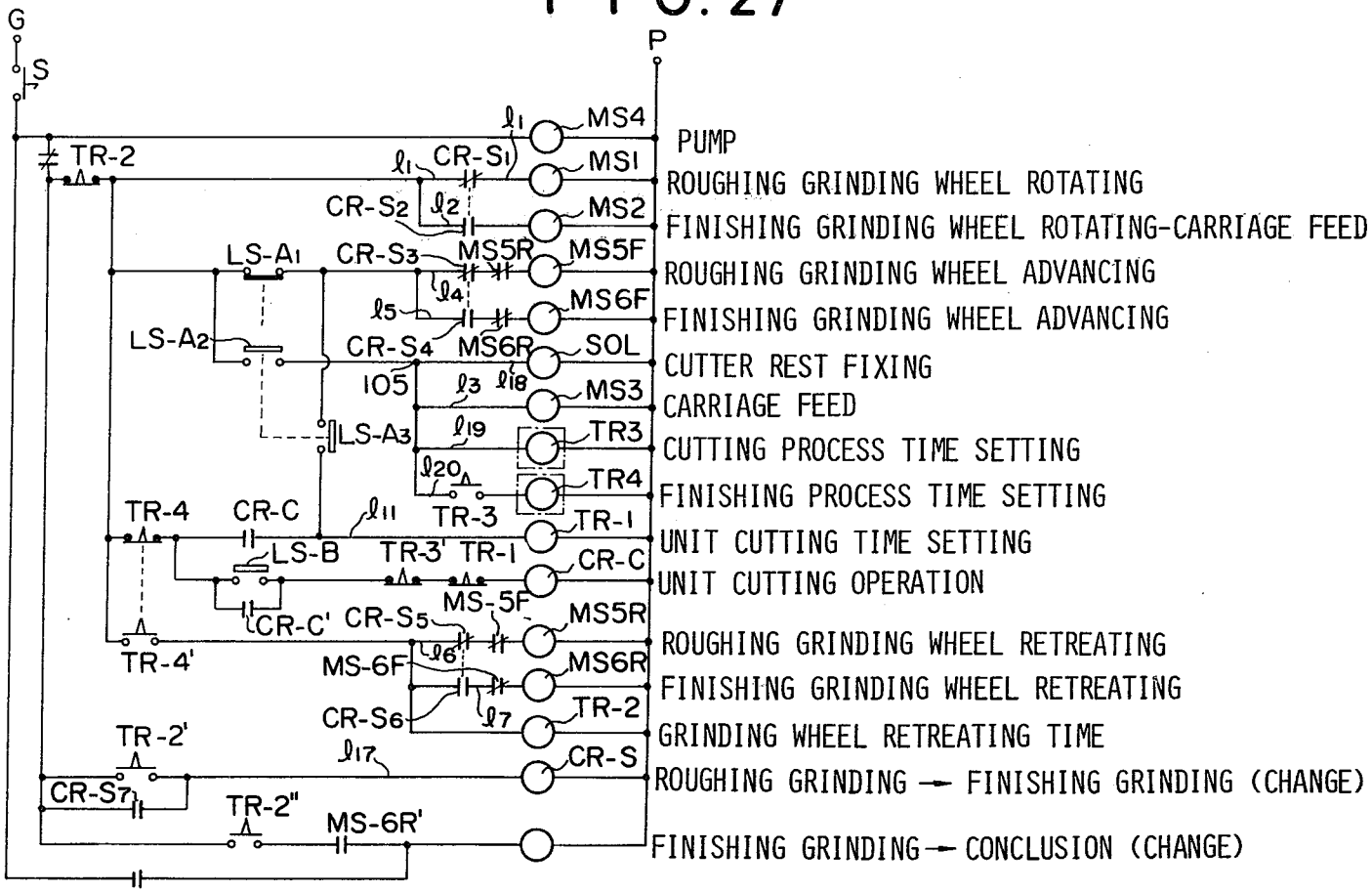
FIG. 27 is an electric circuit diagram showing an example of a sequential-control circuit used in the 3rd Embodiment of the present invention.
Figure 28A:
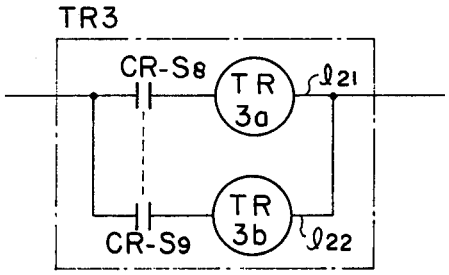
FIG. 28 (A) and FIG. 28 (B) are electric circuit diagrams respectively showing in detail a 3rd timer and a 4th timer contained therein.
Figure 28B:
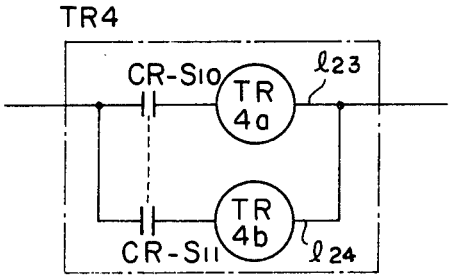

The only difference of the 3rd Embodiment from the 1st embodiment is that it comprises a sequential control circuit shown in FIGS. 27 and 28 (A) and 28B in place of the circuit shown in FIG. 11. Any of the mechanical compositions shown in FIGS. 1 to 8, any of the proximate position-detecting means shown in FIGS. 13 to 19, and any of the proximate position-detecting means with fine adjustment devices shown in FIGS. 20 to 22 may be applied to the 3rd Embodiment without modification.

Therefore, description will be made only of the sequential control circuit shown in FIGS. 27 and 28 (A) and 28 (B).

In FIGS. 27 and 28 (A) and 28 (B), members, etc. which are the same as, or equivalent to, those shown in FIG. 11 are represented by the same numerals and symbols.

In FIG. 27, the roughing grinding wheel rotating circuit l1, finishing grinding wheel rotating circuit l2, roughing grinding wheel advancing circuit l4, finishing grinding wheel advancing circuit l5, etc. are substantially the same in function as those in FIG. 11.

The most noticeable difference of the sequential control circuit in FIG. 27 from that in FIG. 11 is that it has a 3rd timer TR3 for setting cutting process time and a 4th time TR4 for setting finishing process time.

Said limit switch LS-A, the position of which is shown in FIG. 5, etc., is provided with a contact "b" LS-A1, and two contacts "a" LS-A2 and LS-A3. The contact "a" LS-A2 is connected in series with said solenoid SOL (See FIG. 5) to form a cutter rest fixing circuit l18.

The 3rd magnetic switch MS3 for driving the carriage feed motor M3, the 3rd timer TR3 for setting cutting process time, and a series circuit comprising a contact TR-3 of the 3rd timer TR3 and the 4th timer TR4 for setting finishing process time are connected in parallel with the solenoid SOL through a node 105 provided between the solenoid SOL and the contact "a" LS-A2. They respectively form a carriage feed circuit l3, a cutting process time setting circuit l19 and a finishing process time setting circuit l20.

A contact "b" TR-3' of the 3rd timer TR3 and a contact "b" TR-4 of the 4th timer TR4 are in a unit cutting time setting circuit l11, etc. A contact "a" TR-4' of the 4th timer TR4 is on a line to a roughing grinding wheel retreating circuit l6, etc.

The 3rd timer TR3 for setting cutting process time and the 4th timer TR4 for setting finishing process time will be described further with reference to FIGS. 28 (A), (B).

As shown in FIG. 28 (A), the 3rd timer TR3 is a parallel circuit comprising a cutting process (roughing grinding) time setting circuit l21 and a cutting process (finishing grinding) time setting circuit l22. The former circuit l21 is a series circuit comprising a contact "b" CR-S8 of the grinding change relay CRS and a cutting process (roughing grinding) time setting timer TR3*a*. The latter circuit l22 is a series circuit comprising a contact "a" CR-S9 of the grinding change relay CRS and cutting process (finishing grinding) time setting timer TR3*b*.

As shown in FIG. 28 (B), the 4th timer TR4 is a parallel circuit comprising a finishing process (roughing grinding) time setting circuit l23 and a finishing process (finishing grinding) time setting circuit l24. The former circuit l23 is a series circuit comprising a contact "b" CR-S10 of the grinding change relay CRS and a finishing process (roughing grinding) time setting timer TR4*a*. The latter circuit l24 is a series circuit comprising a contact "a" CR-S11 of the grinding change relay CRS and a finishing process (finishing grinding) time setting timer TR4*b*.

Description will now be made of the grinding process by means of the timers.

Referring first to the operation of the roughing grinding wheel system, when the roughing grinding wheel G1 has come into contact with the ground surface 10' of the cutter 10, the limit switch LS-A is actuated. Then, the solenoid SOL is excited, and the cutter rest 7 is attracted and fixed thereby. Now the roughing grinding wheel system is ready for subsequent roughing grinding operation.

At the same time that the solenoid SOL is excited, the 3rd magnetic switch MS3 and the cutting process (roughing grinding) time setting timer TR3*a* in the 3rd timer TR3 are respectively energized. Therefore, the carriage feed motor M3 is started, and the carriage reciprocating mechanism comprising the changeover lever 43, stroke control members 46,46', etc. operate. Thus, the carriage 3 starts reciprocating. As the carriage 3 reciprocates, the counting limit switch LS-B is repeatedly turned on and off by the switch-actuating lever 47. Each time the counting limit switch LS-B is turned on, the grinding wheel advance starting relay CRC is excited and the 1st timer TR1 is actuated. The roughing grinding wheel feed motor M5 operates each time for a unit cutting period of time set by the 1st timer TR1 to advance the roughing grinding wheel G1 slightly. Thus, the cutting operation, as the first half of the roughing grinding operation, is started, and is repeated for a period of time set by the cutting process (roughing grinding) time setting timer TR3*a*.

Even after the lapse of the preset period of time for the cutting operation, as the first half of the roughing grinding operation, the cutter 10 still continues to reciprocate, and the roughing grinding wheel G1 remains in the final cutting position. Therefore, the roughing grinding wheel G1 now performs the finishing operation as the second half of the roughing grinding operation.

The finishing operation is continued for a period of time set by the finishing process (roughing grinding) time setting timer TR4*a*. After the lapse of this period, the contact "b" TR-4 and contact "a" TR-4' of the 4th timer TR4 operate so as to close the roughing grinding wheel retreating circuit l6. Thus, the roughing grinding wheel retreating magnetic switch MS5R is actuated, and the roughing grinding wheel G1 starts to retreat. The retreat thereof is continued for a period of time set by the 2nd timer TR2.

Said finishing operation is not always necessary and may be omitted.

After the lapse of the period of time set by the 2nd timer TR2, the contact "b" TR-2 thereof is turned off. Then, the roughing grinding wheel rotating motor M1 and the carriage feed motor M3 are stopped, and the fixing of the cutter rest 7 is released. Now the roughing grinding process is concluded.

The contact "b" TR-2 of the 2nd timer TR2 is turned on again. The contact "a" TR-2' of the 2nd timer TR2 is turned on after the lapse of the period of time set thereby. Then, the roughing grinding-finishing grinding change circuit l17 is closed, and the grinding change relay CRS maintains itself.

Therefore, all the contacts "a" in the contacts CR-S1 to CR-S11 of the grinding change relay CRS are turned on. Now the control circuits for the finishing grinding wheel system, including the finishing grinding wheel rotating circuit l2 and the finishing grinding wheel advancing circuit l5, start to operate. The sequence of operation of the finishing grinding wheel system is substantially the same as that of the roughing grinding wheel system. In the finishing grinding wheel system, however, the periods of time set by the timers such as the cutting process (finishing grinding) time setting timer TR3*b* are shorter than those in the roughing grinding wheel system, because each process therein can be made shorter.

As many apparently widely different embodiments of this invention may be made without departing from the spirit and scope thereof, it is to be understood that the invention is not limited to the specific embodiments thereof except as defined in the appended claims.

What is claimed is:

1. A cutter grinding machine comprising;

a cutter rest to which a cutter to be ground is attached;

a rough grinding wheel coupled to a rough grinding wheel drive motor and movable toward and away from said cutter rest by a rough grinding wheel feed motor;

a finish grinding wheel coupled to a finish grinding wheel drive motor and movable toward and away from said cutter rest by a finish grinding wheel feed motor;

a carriage reciprocated transversely of said grinding wheels by a reciprocating mechanism, said cutter rest being pivotably mounted on said carriage and adjustable about said pivot mounting;

a proximate position detecting means including a switch-actuating lever coupled to said cutter rest, a solenoid for fixing said cutter rest, which is mounted on a support plate fixed to the carriage side, and a limit switch mounted on said support plate at a position functionally corresponding to said switch-actuating lever, said proximate position detecting means being arranged so that when either said rough grinding wheel or said finish grinding wheel is advanced and brought into contact with the ground surface of said cutter said limit switch is actuated to stop the feed motor associated with said one grinding wheel brought into contact with said ground surface and to energize said solenoid for attracting and fixing said cutter rest thereto; and a carriage reciprocation counting means including a counting limit switch for counting the reciprocating motions of said carriage and a stepping relay which is responsive to said counting limit switch to step up each time the latter is actuated by the reciprocation of said carriage, said carriage reciprocation counting means being adapted so that said reciprocating mechanism is actuated to reciprocate said carriage until said stepping relay steps up a preset number;

wherein a sequential control system is provided for controlling the machine operation so that first said rough grinding wheel is advanced toward said cutter until said proximate position detecting means is actuated, whereupon the advancement thereof is temporarily stopped and the roughing operation is started and continued until said carriage has reciprocated said preset number of times, whereupon said rough grinding wheel is retreated, and then said finish grinding wheel is advanced toward said cutter until said proximate position detecting means is actuated, whereupon the advancement thereof is temporarily stopped and the finish grinding operation is started and continued until said carriage has reciprocated said preset number of times, whereupon said finish grinding wheel is retreated.

2. A cutter grinding machine comprising:

a cutter rest to which a cutter to be ground is attached;

a carriage carrying said cutter rest and reciprocatable by a reciprocating mechanism;

a grinding wheel coupled to a grinding wheel drive motor mounted on a mount, said mount being supported on a slide rest and being urged pivotally around a shaft toward said cutter rest by a spring means;

a grinding wheel feed motor for moving said grinding wheel slide rest toward and away from said cutter rest;

a proximate position detecting means including a solenoid mounted on said slide rest for fixing said mount, a switch-actuating piece provided on the free end side of said mount, and a detecting switch provided on said slide rest side at a position functionally corresponding to said switch-actuating piece, said proximate position detecting means being arranged so that when said grinding wheel is brought into contact with the ground surface of said cutter said mount is turned, against the action of said spring means, to actuate said detecting switch through said switch-actuating piece to stop said grinding wheel feed motor and to energize said solenoid for attracting and fixing said mount thereto; and a carriage reciprocation counting means including a counting limit switch for counting the reciprocating motions of said carriage and a stepping relay which is responsive to said counting limit switch to step up each time the latter is actuated by the reciprocation of said carriage, said carriage reciprocation counting means being adapted so that said reciprocating mechanism is in an actuated state to reciprocate said carriage until said stepping relay steps up a preset number;

wherein said grinding wheel is first advanced toward said cutter until said proximate position detecting means is actuated, whereupon the advancement of said grinding wheel is temporarily stopped and the grinding operation is started and continued until said carriage has reciprocated said preset number of times.

3. A cutter grinding machine comprising:

a cutter rest to which a cutter to be ground is attached;

a carriage carrying said cutter rest and reciprocatable by a reciprocating mechanism;

a grinding wheel coupled to a grinding wheel drive motor mounted on a mount which is supported on a slide rest;

a grinding wheel feed motor for moving said grinding wheel slide rest toward and away from said cutter rest interlinkedly with a threaded feed shaft;

means for urging said slide rest toward said cutter rest;

a proximate position detecting means including a detecting switch facing the end of said feed shaft remote from the threaded portion thereof and a solenoid provided at said end side of said feed shaft for fixing said slide rest, said proximate position detecting means being arranged so that when said grinding wheel is brought into contact with the ground surface of said cutter said slide rest is retreated, against the action of said urging means, to actuate said detecting switch through said feed shaft to stop said grinding wheel feed motor and to energize said solenoid for attracting and fixing said slide rest thereto; and a carriage reciprocation counting means including a counting limit switch for counting the reciprocating motions of said carriage and a stepping relay which is responsive to said counting limit switch to step up each time the latter is actuated by the reciprocation of said carriage, said carriage reciprocation counting means being adapted so that said reciprocating mechanism is actuated to reciprocate said carriage until said stepping relay steps up a preset number;

wherein said grinding wheel is first advanced toward said cutter until said proximate position detecting means is actuated, whereupon the advancement of said grinding wheel is temporarily stopped and the grinding operation is started and continued until said carriage has reciprocated said preset number of times.

4. A cutter grinding machine comprising;

a cutter rest to which a cutter to be ground is attached;

a rough grinding wheel coupled to a rough grinding wheel drive motor and movable toward and away from said cutter rest by a rough grinding wheel feed motor;

a finish grinding wheel coupled to a finish grinding wheel drive motor and movable toward and away from said cutter rest by a finish grinding wheel feed motor;

a carriage reciprocated transversely of said grinding wheels by a reciprocating mechanism, said cutter rest being pivotably mounted on said carriage and adjustable about said pivot mounting;

a first proximate position detecting means for detecting a predetermined proximate position between said cutter and said rough grinding wheel;

a composite means composed of a second proximate position detecting means for detecting a predetermined proximate position between said cutter and said finish grinding wheel and a pressing means for pressing said finish grinding wheel against said cutter, said composite means including a movable piece meshed with a threaded feed shaft associated with said finish grinding wheel feed motor, a compression spring disposed between said movable piece and a slide rest for said finish grinding wheel so as to urge said movable piece in the direction opposite to the advance of said finish grinding wheel, and a limit switch disposed between said movable piece and said slide rest, said second proximate position detecting means being in such a cooperating relationship with said pressing means that when said finish grinding wheel is brought into contact with the cutter said movable piece is advanced somewhat further, against the force of said spring, to actuate said limit switch upon attaining an adequate compression of said spring and said finish grinding wheel feed motor is stopped by the actuation of said limit switch, leaving said compressed spring to press said finish grinding wheel against the cutter, and a carriage reciprocation counting means including a counting limit switch for counting the reciprocating motions of said carriage and a stepping relay which is responsive to said counting limit switch to step up each time the latter is actuated by the reciprocation of said carriage, said carriage reciprocation counting means being adapted so that said reciprocating mechanism is in actuated state thereof to reciprocate said carriage until said stepping relay steps up a preset number; and a sequential control system for controlling the machine operation so that first said rough grinding wheel is advanced toward said cutter until said first proximate position detecting means is actuated, whereupon the advancement of said rough grinding wheel is temporarily stopped and the roughing operation is started and continued until said carriage has reciprocated said preset number of times, whereupon said rough grinding wheel is retreated, and then said finish grinding and then said finish grinding wheel is advanced toward said cutter until said second proximate position detecting means is actuated, whereupon the advancement of said finish grinding wheel is temporarily stopped and the finish grinding operation is started and continued until said carriage has reciprocated said preset number of times, whereupon said finish grinding wheel is retreated.

5. A cutter grinding machine comprising:

a cutter rest to which a cutter to be ground is attached;

a rough grinding wheel coupled to a rough grinding wheel drive motor and movable toward and away from said cutter rest by a rough grinding wheel feed motor;

a finish grinding wheel coupled to a finish grinding wheel drive motor and movable toward and away from said cutter rest by a finish grinding wheel feed motor;

a carriage reciprocated transversely of said grinding wheels, by a reciprocating mechanism, said cutter rest being pivotably mounted on said carriage and adjustable about said pivot mountings;

a fist proximate position detecting means for detecting a predetermined proximate position between said cutter and said rough grinding wheel;

a composite means composed of a second proximate position detecting means for detecting a predetermined proximate position between said cutter and said finish grinding wheel and a pressing means for pressing said finish grinding wheel against said cutter, said composite means including a compression spring member disposed between the rotating shaft of said finish grinding wheel drive motor and the body thereof so as to urge said rotating shaft in the direction opposite to the advance of said finish grinding wheel, and a limit switch faced to the end of said rotating shaft remote from said drive motor body, said second proximate position detecting means being in such a cooperating relationship with said pressing means that when said finish grinding wheel is brought into contact with the cutter said drive motor body is advanced somewhat further, against the force of said spring member, to actuate said limit switch upon attaining an adequate compression of said spring and said finish grinding wheel feed motor is stopped by the actuation of said limit switch, leaving said compression spring to press said finish grinding wheel against the cutter; and a carriage reciprocation counting means including a counting limit switch for counting the reciprocating motions of said carriage and a stepping relay which is responsive to said counting limit switch to step up each time the latter is actuated by the reciprocation of said carriage, said carriage reciprocation counting means being adapted so that said reciprocating mechanism is in actuated state thereof to reciprocate said carriage until said stepping relay steps up a preset number; and a sequential control system for controlling the machine operation so that first said grinding wheel is advanced toward said cutter until said first proximate position detecting means is actuated, whereupon the advancement of said rough grinding wheel is temporarily stopped and the roughing operation is started and continued until said carriage has reciprocated said preset number of times, whereupon said rough grinding wheel is retreated, and then said finish grinding wheel is advanced toward said cutter until said second proximate position detecting means is actuated, whereupon the advancement of said finish grinding wheel is temporarily stopped and the finish grinding operation is started and continued until said carriage has reciprocated said preset number of times, whereupon said finish grinding wheel is retreated.

* * * * *